US005955708A

United States Patent [19]

Amano et al.

[11] Patent Number: 5,955,708

[45] Date of Patent: Sep. 21, 1999

[54] CONTROL DEVICE FOR ELEVATORS

[75] Inventors: Masaaki Amano; Hiroyo Takahashi; Kiyoji Kawai, all of Tokyo, Japan

[73] Assignee: Mitsubishi Denki Kabushiki Kaisha, Tokyo, Japan

[21] Appl. No.: 08/981,482

[22] PCT Filed: Oct. 29, 1996

[86] PCT No.: PCT/JP96/03170

§ 371 Date: Dec. 24, 1997

§ 102(e) Date: Dec. 24, 1997

[87] PCT Pub. No.: WO98/18708

PCT Pub. Date: May 7, 1998

[51] Int. Cl.[6] ..... B66B 1/28; B66B 1/16; B66B 1/20

[52] U.S. Cl. ..... 187/247; 187/383; 187/380

[58] Field of Search ..... 187/247, 248, 187/380, 382, 383, 386

[56] References Cited

U.S. PATENT DOCUMENTS

| | | | |
|---|---|---|---|
| 5,202,540 | 4/1993 | Auer et al. | 187/247 |
| 5,345,049 | 9/1994 | Bahjat et al. | 187/382 |
| 5,427,206 | 6/1995 | Powell et al. | 187/387 |
| 5,551,532 | 9/1996 | Kupersmith | 187/391 |
| 5,563,386 | 10/1996 | Poell et al. | 187/382 |

FOREIGN PATENT DOCUMENTS

| | | | |
|---|---|---|---|
| 0663366 | 7/1995 | European Pat. Off. | B66B 1/18 |
| 49-12553 | 2/1974 | Japan . | |
| 54-146365 | 11/1979 | Japan . | |
| 57-85774 | 5/1982 | Japan . | |
| 60-2577 | 1/1985 | Japan . | |
| 61-81372 | 4/1986 | Japan . | |
| 61-188376 | 8/1986 | Japan . | |
| 6-80322 | 3/1994 | Japan . | |
| 08113435 | 5/1996 | Japan . | |
| 2065327 | 6/1981 | United Kingdom . | |
| 8101548 | 6/1981 | WIPO . | |

*Primary Examiner*—Robert E. Nappi
*Attorney, Agent, or Firm*—Leydig, Voit & Mayer, Ltd.

[57] ABSTRACT

Information is transmitted between respective control units to respond to a landing call made backward of other elevators in an elevator control apparatus with dispersed group management function, abolishing a group management device. An elevator control apparatus is included with each of the cars of a plurality of elevators whose operation is managed as one group. A car control unit controls the operation of respective elevator cars. A car information transmission unit transmits information such as car location, car direction, car load, the state of occurrence of car call, and the like between a first elevator and other elevators. A landing information transmission unit transmits information to landing equipment located at a landing such as landing buttons, a landing indicator, a hall lantern and the like. A group management control unit determines an assignment zone assigned to the first elevator based on car information, including the car position and the travelling direction of the elevator and of other elevators, from the car control unit and the car information transmission units. The group management control unit assigns a landing call made in the assignment zone of the first elevator to the first elevator based on the landing information from the landing information transmission units. Further, the elevators wait when a closer car is assigned or there is no call to answer.

16 Claims, 18 Drawing Sheets

CONTROL DEVICE FOR ELEVATORS

TECHNICAL FIELD

The present invention relates to an elevator control apparatus, and more specifically, to an elevator control apparatus for managing at least two sets of cars by abolishing a group management device.

BACKGROUND ART

Lately, it has become possible for a controller for controlling elevators to arithmetically process a lot of information and carry out high degree control by the employment of a microcomputer.

Incidentally, several proposals are made to recent elevator control apparatuses to abolish a group management device for managing a plurality of elevators and disperse the function of the device to respective elevator control apparatuses.

For example, Japanese Unexamined Patent Publication No. 61-188376 discloses a control system arranged such that respective controllers are provided with a function for processing a call input and a call, the most significant controller of them is designated as a main station and the other controllers are designated as other stations according to a predetermined priority, the main station collects information and supplies it to the respective stations and one of the respective stations having an optimum response evaluation assigns a response to it.

Japanese Examined Patent Publication No. 5-39873 discloses a control system arranged such that each of main control units disposed in respective cars for controlling the operation thereof calculates the evaluation value of its own elevator for each landing call. Each unit inputs and outputs information such as the evaluation value and the like and responds to the landing call when its own elevator is optimally evaluated. The respective control units are connected to one another, and when a group management fails, at least one of the main control units registers a call and transmits information of a landing call to the respective control units.

Japanese Unexamined Patent Publication No. 6-80322 discloses a control system arranged such that any one of a plurality of control units is designated as a main station and the other control units are designated as substations, the main station processes a control function to be processed in real time by synchronously controlling the control units of all the elevators and the control units of the respective elevators share a control function to be cyclically processed.

Japanese Examined Patent Publication No. 6-39312 discloses a control system arranged such that a command is output from a main station to a transmission line in the state that group management is not carried out by respective control units and management is controlled by designating a control unit which controls a transmission control line at the earliest timing as a main station and the other control units are designated as subunits which follow the main unit.

However, the aforesaid prior art has the following problems. That is, although the prior arts provide the respective car controllers with a part of a group management function, they do not particularly disclose any procedure for assigning a call made at a landing and employ an assigning system based on an evaluated value like an ordinary group-managed elevator. Therefore, the respective controllers must calculate an evaluation value based on an enormous amount of information similar to an evaluation value calculated by a group management device, thus high degree arithmetic processing must be carried out using limited hardware (H/W) resources regardless of the fact that a group management device is abolished at great pains. Further, a cost is also increased.

Further, there is conventionally proposed an elevator selective collective system as a method of effectively operating about two sets of cars ("Elevator and Escalator for Building Utility", page 26, published by Ohm Ltd.). This method is arranged such that cars towards each other respond to a car call while also responding to a landing call made after they pass. That is, an upward landing call and a downward landing call produced on a landing are regarded as a train of continuous cyclic calls and only a landing call which is located forward of an own elevator and backward of a car travelling just ahead of the own elevator is assigned to the own elevator. According to this method, when the distance between an elevator and an advancing car is made shorter, the number of assignment of landing calls made therebetween is more reduced. Therefore, the advancing car is liable to be easily cached, by which there is caused a parallel operation in which two elevators travel in the same direction at the same time.

Taking the above problems into consideration, an object of the present invention is to provide an elevator control apparatus capable of managing a plurality of cars by a simple and less expensive arrangement by an operation different from the assignment system based on evaluation and the selective collective system even if a group management device is abolished.

DISCLOSURE OF THE INVENTION

A first embodiment of the present invention is arranged such that an elevator control apparatus provided with each of the cars of a plurality of elevators whose operation is managed as one group comprises car control means for controlling the operation of respective elevator cars, car information transmission means for transmitting information such as car location, car direction, car load, the state of occurrence of car call and the like between an own elevator and other elevators, landing information transmission means for transmitting information to landing equipment disposed to a landing such as landing buttons, a landing indicator, a hall lantern and the like, and group management control means for determining an assignment zone assigned to the own elevator based on car information including the car position and the travelling direction of the own elevator and the other elevators obtained from the car control means and the car information transmission means and assigning a landing call made in the assignment zone of the own elevator to it based on the landing information from the landing information transmission means.

A second embodiment of the present invention is the elevator control apparatus according to the first invention arranged such that the group management control means assigns the floors ranging from the floor where the car of the own elevator is located to the final floor located forward of the travelling direction of the own elevator and the floors located backward of the travelling direction of the own elevator and further located backward of the car position the other elevators in the traveling direction thereof.

A third embodiment of the present invention is the elevator control apparatus according to the first or second embodiment arranged such that the car control means includes call response means which, when there is an elevator responding earlier to a landing call assigned to the plurality of the elevators, issues a response signal to the landing call as well as issues a signal to the other elevators to cause them to cancel the landing call assigned thereto.

A fourth embodiment of the present invention is the elevator control apparatus according to the first embodiment arranged such that the group management control means includes an assignment review means which, after it is decided that the own elevator is assigned to the call to respond to it, reviews the assignment each time a landing call is made if the state of the own elevator satisfies a predetermined condition.

A fifth embodiment of the present invention is the elevator control apparatus according to the fourth embodiment arranged such that the car control means includes a car load detection means for detecting the weight of passengers and the like in the car and the predetermined condition of the state of the own elevator in the assignment review means is the condition that the interior of the car is made to no load and the door of the car is closed.

A sixth embodiment of the present invention is the elevator control apparatus according to the fourth embodiment arranged such that the car control means includes a car load detection means for detecting the weight of passengers and the like in the car and the predetermined condition of the state of the own elevator in the assignment review means is the condition that when a response is made to a final car call, there is no landing call on the floor.

A seventh embodiment of the present invention is the elevator control apparatus according to any of the fourth to sixth inventions arranged such that the assignment review means cancels the assignment call of the own elevator which is located forward of the travelling direction of the own elevator as well as forward of the travelling direction the other elevators.

An eighth embodiment of the present invention is the elevator control apparatus according to the fourth invention arranged such that the car control means includes a car load detection means for detecting the weight of passengers and the like in the car, and the group management control means includes a car forward means for forwarding, when the car load detection means detects that loads got on the car at one or a plurality of predetermined floors exceed a predetermined value, the car to a predetermined waiting floor before the assignment review means reviews assignment, wherein after the car is forwarded, the assignment review means reviews the assignment of the call.

A ninth embodiment of the present invention is the elevator control apparatus according to the eighth invention arranged such that when the car of the other elevator is being forwarded toward a predetermined waiting floor, the forward means does not forward the own elevator to the waiting floor.

A tenth embodiment of the present invention is the elevator control apparatus according to the eighth invention arranged such that when the car of the other elevator is being forwarded toward a predetermined waiting floor, the forward means forwards the own elevator to a predetermined other waiting floor.

BEST MODE FOR CARRYING OUT THE INVENTION

The respective embodiments of the present invention will be described below based on the drawings.

Embodiment 1

Figure 1:
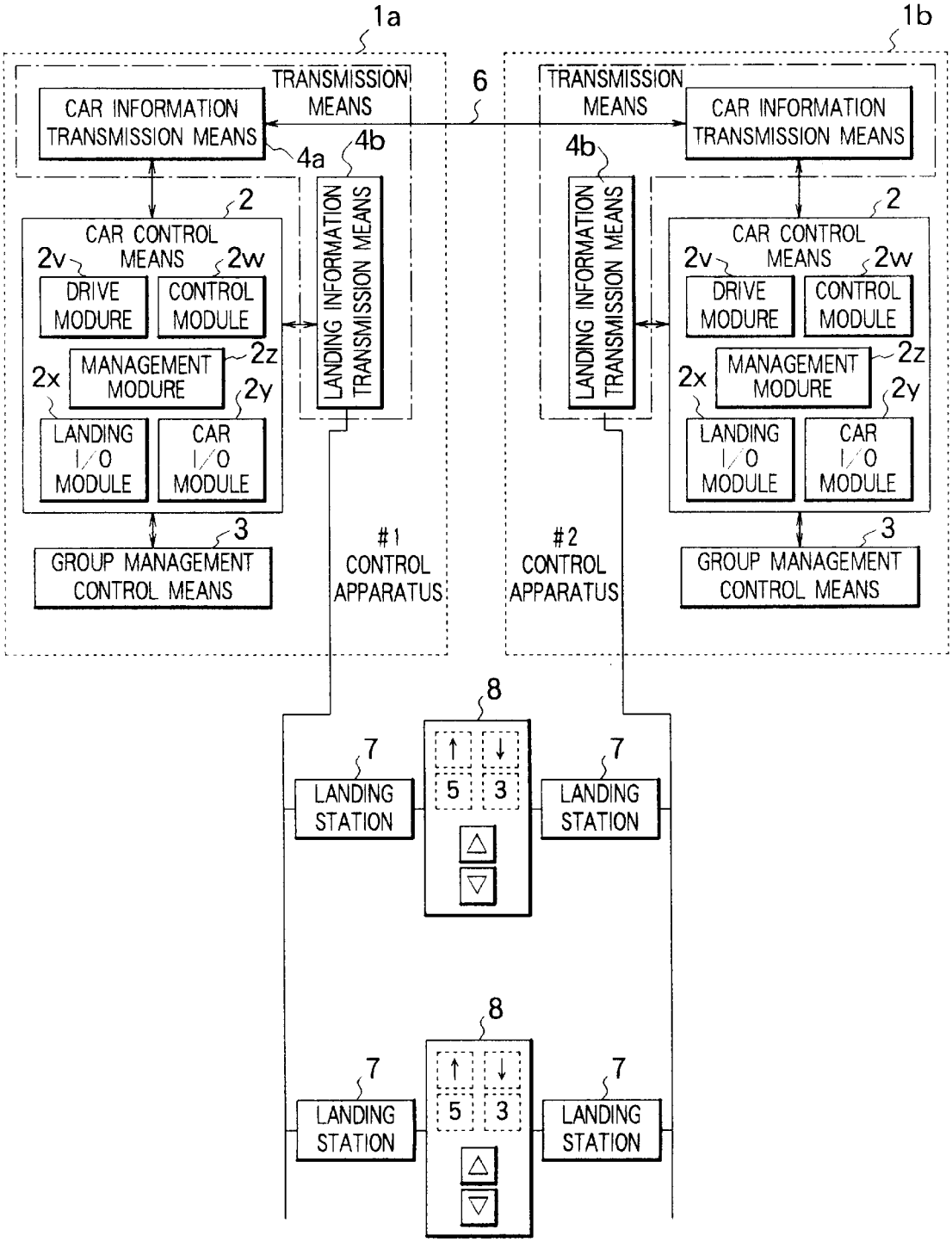
FIG. 1 is a block diagram showing the general arrangement of an elevator control apparatus according to an embodiment of the present invention.

FIG. 1 is a block diagram showing the general arrangement of an elevator control apparatus according to an embodiment of the present invention. This is an example in which two elevator controllers are disposed without the provision of a separate group management device. Numerals 1*a*, 1*b* denote #1 and #2 control apparatuses for controlling respective elevators as a whole and the controllers have the same arrangement. Numeral 2 denotes car control means for managing the entire operation of respective elevator cars (not shown) and the car control means basically includes, for example, respective modules 2*v*–2*z* of drive, control, input/output of landings, input/output of cars and management.

Numeral 3 denotes group management control means disposed to the respective car control apparatuses 1*a*, 1*b* for assigning a call and forwarding a car in a crush.

Numeral 4 denotes transmission means for transmitting information to car equipment (not shown) mounted on each car and landing equipment disposed to each landing (numerals 7, 8 to be described later). Numeral 4*a* denotes landing information transmission means for transmitting information to the landing equipment. Numeral 6 denotes an optical fiber cable for connecting the two control means 1*a*, 1*b* to each other, numeral 7 denotes a landing station disposed at each landing for transmitting information to the landing information transmission means 4*b*, numeral 8 denotes a landing unit in which a landing indicator, a direction lamp and landing buttons are integrally disposed. The landing unit 8 may include a hall lantern for displaying the prediction of an assigned car and arrival.

Figure 2:
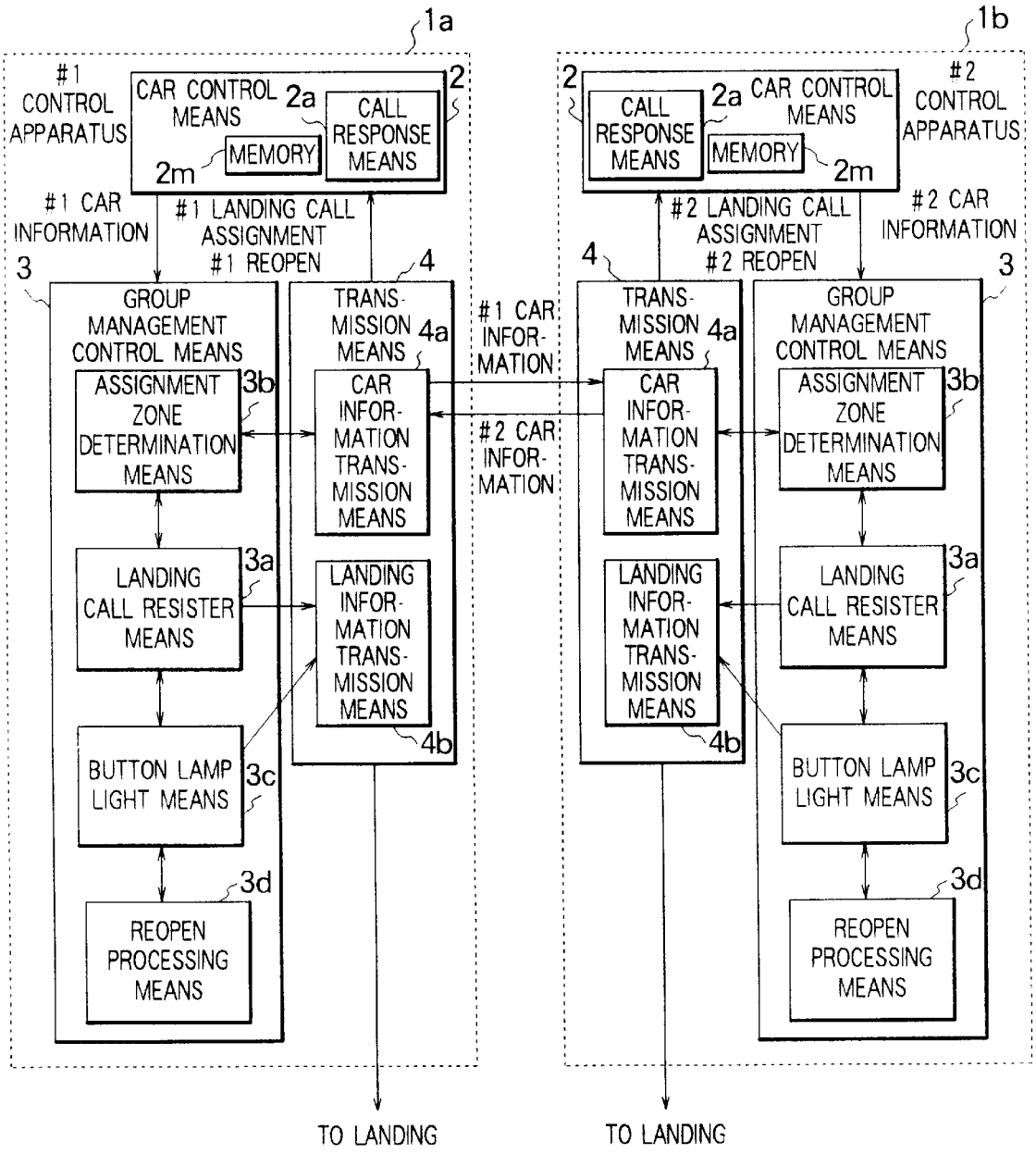
FIG. 2 is a block diagram showing the arrangement of a control apparatus for explaining the operation of an embodiment 1.

FIG. 2 is a block diagram showing the arrangement of a control apparatus for explaining operation according to the present invention, wherein numeral 3 denotes the group management control means for assigning a call and forwarding a car in a crush and the group management control means is composed of four sets of processing means. Numeral 3*a* denotes landing call register means for registering and cancelling a landing call based on landing button information supplied from the landing information transmission means 4*b*, numeral 3*b* denotes assignment zone determination means for determining the floor zone of a landing call assigned to its elevator, numeral 3*c* denotes button lamp light means for lighting the lamps of landing buttons and numeral 3*d* denotes reopen processing means for reversing and opening a door.

In the car control means 2, numeral 2*a* denotes a call response unit for causing the own elevator to respond to the landing call assigned thereto and numeral 2*m* denotes a memory in which stored is information as to the state of cars such as the present position of a car, the time at which a car is made empty, and the like.

Note, since two cars may be assigned to one landing call in the embodiment as described later, the call response means 2*a* carries out such control that when there is a car which responds to a registered landing call earlier than the other elevator, the landing call is cancelled as well as the assignment of the landing call to the other elevator is also cancelled to prevent the phenomenon that a plurality of cars travel in the same direction at the same time as much as possible.

In the assignment of a landing call (a call made by a landing button), although there is conventionally employed an arithmetic operation for system evaluation which calculates predicted wait times until respective cars reach floors where landing calls are made to optimize the overall wait time at respective landings, since this evaluation system requires arithmetic operation for the respective cars and the respective landings, a CPU must carry out arithmetic operations for a considerable period of time and a considerable space of a memory must be occupied. Thus, it is difficult to realize this system by a simple arrangement.

To cope with this problem, according to the present embodiment an assignment zone determination means 3*b* causes respective cars to respond to a zone determined by the assignment zone determination means when a landing call is made forward of the travelling direction of a car. The car assigns the call to it as a call directed thereto even if the call is made forward of the other elevator travelling ahead of the above car to avoid complex arithmetic operation for evaluation. Further, when a landing call is made backward of a car and the landing call is also a backward call to the other elevator, the above car assigns the call to it as a call directed thereto. This embodiment can be simply realized by the aforesaid manner in which the respective elevators make determination as described above and further passengers at a landing do not feel strange about the cars operated by the embodiment. That is, in the above determination system, a landing call may be assigned to a plurality of elevators different from a conventional determination system.

Zone assignment made by the assignment zone determination means 3*b* will be described here based on FIG. 3 to FIG. 6. FIG. 3 to FIG. 6 show the zone assignment made by the assignment zone determination means 3*b* in accordance with a flowchart to be described later, in which shown is a case that two elevator cars are installed in an eight-storied building having the first floor (1F) to the eighth floor (8F). Note, the portion of right-ascending hatching shows a zone assigned to a #1 elevator, the portion of right-descending hatching shows a zone assigned to a #2 elevator, and black circles show a car call (a call made by a button in a car).

Figure 3:
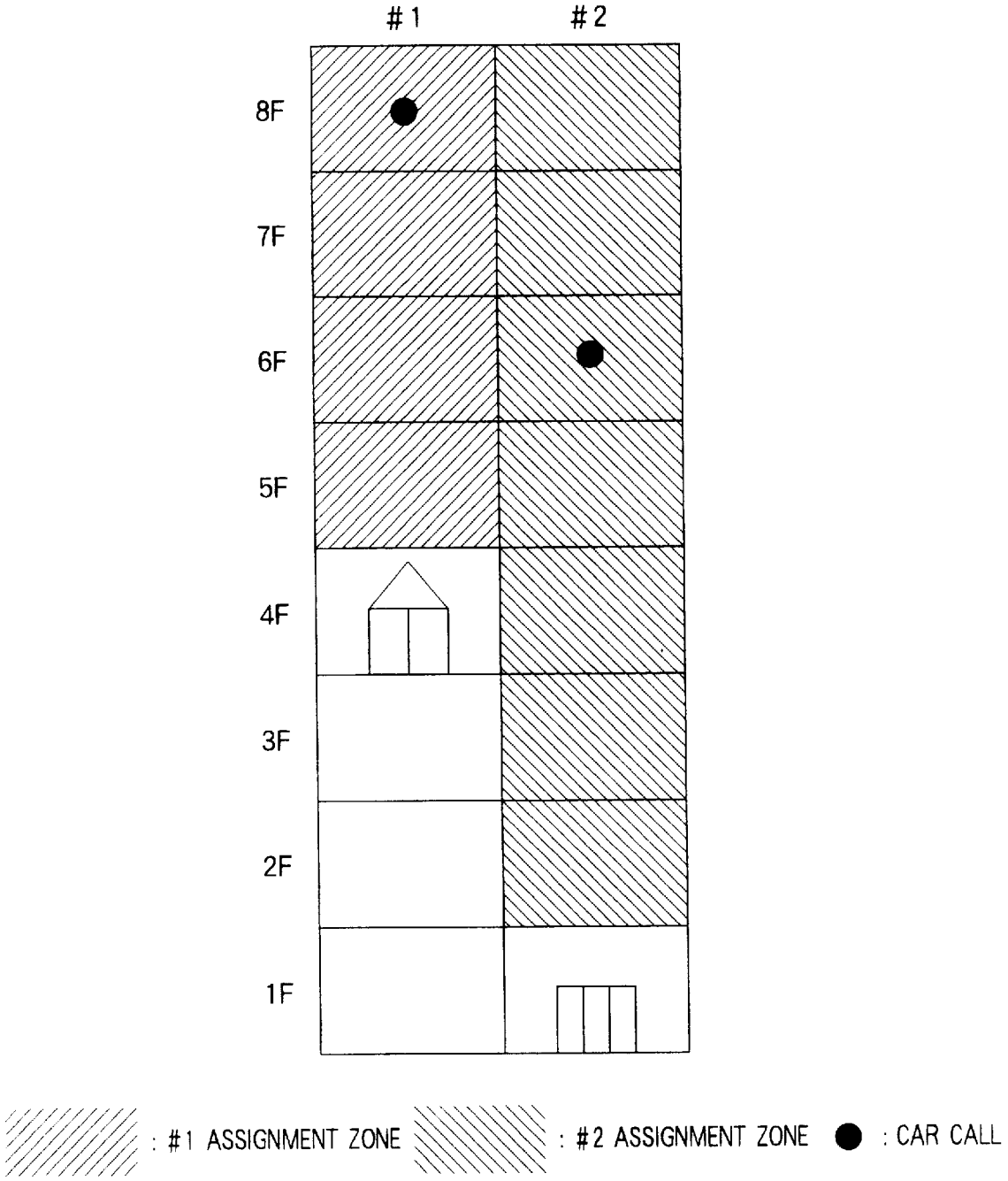
FIG. 3 is a view explaining assignment zone determination means.

In FIG. 3, the #1 elevator travels upward through 5F with a car call to 8F and the #2 elevator stops at 1F with its door open. In this case, the #1 elevator is assignable to a landing call made from 5F to 8F and the #2 elevator is assignable to a landing call made from 2F to 8F in accordance with the flowchart to be described later. Therefore, the assignment zones are determined to the respective cars as shown in the drawing.

Figure 4:
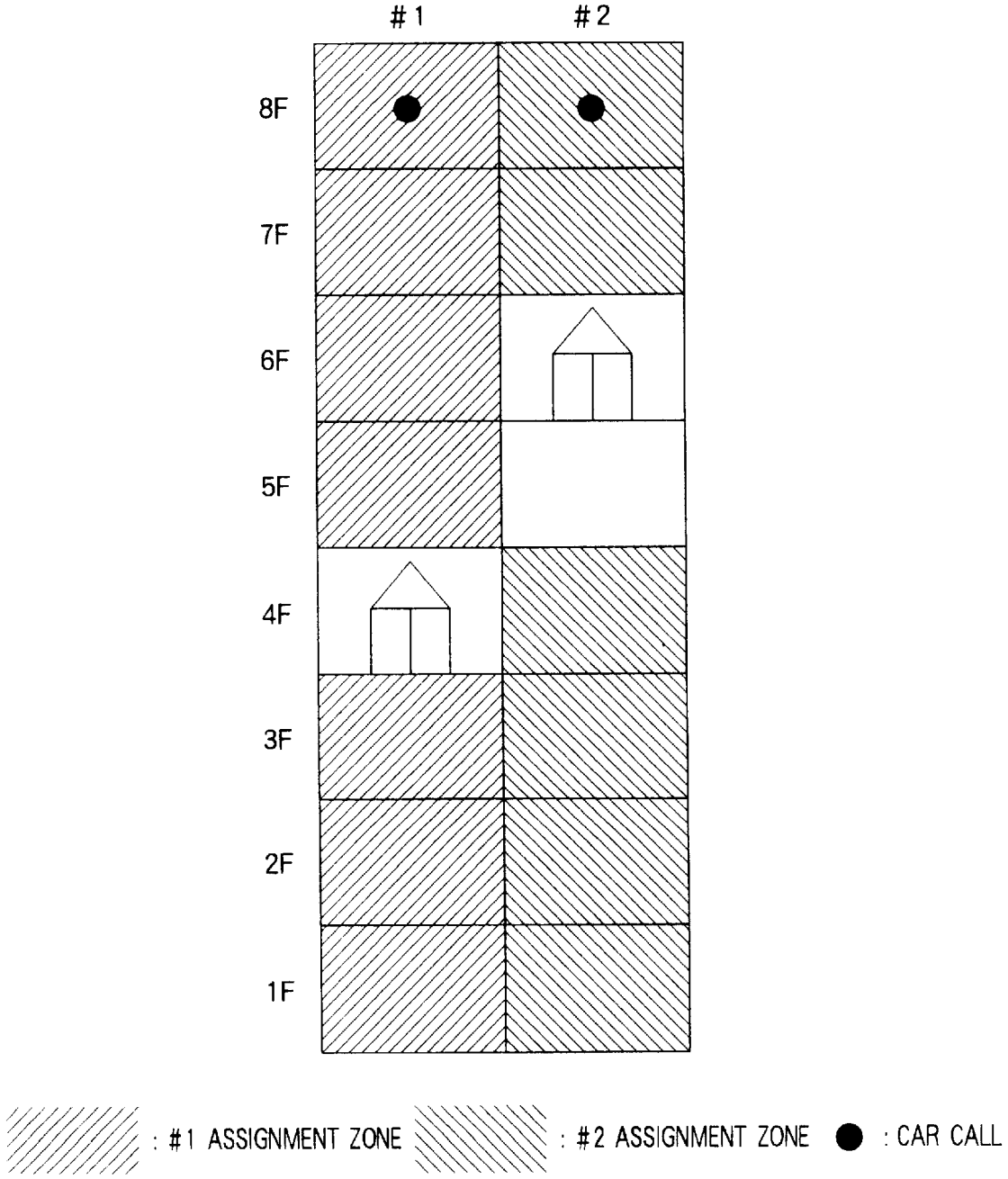
FIG. 4 is a view explaining the assignment zone determination means.

In FIG. 4, the #1 elevator travels upward through 4F with a car call to 8F and the #2 elevator travels upward through 6F with a car call to 8F. In this case, the #1 elevator is assignable to a landing call made from 5F to 8F located forward of it and to a landing call made on 1F to 3F which are located backward of both the #1 and #2 elevators and the #2 elevator is assignable to a landing call made on 7F and 8F which are located forward of it and to a landing call made on 1F to 4F which are backward of both the #1 and #2 elevators. Note, a floor which is located backward of the own elevator and where it cannot stop because the other elevator travels therethrough is included in the floor located backward of the own elevator (for example, 4F in the #2 elevator in FIG. 4).

Figure 5:
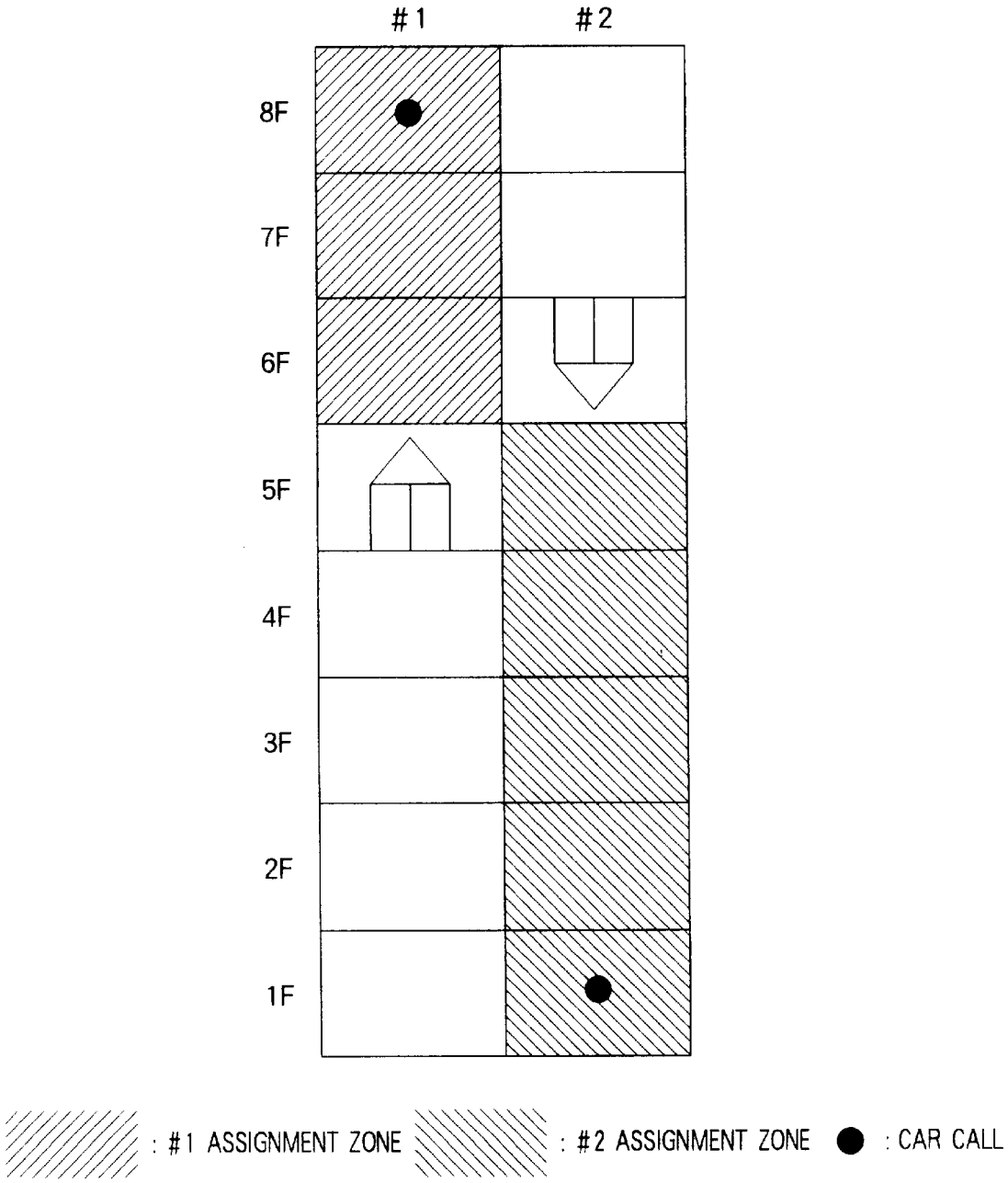
FIG. 5 is a view explaining the assignment zone determination means.

In FIG. 5, the #1 elevator travels upward through 5F with a car call to 8F and the #2 elevator travels downward through 6F with a car call to 1F. In this case, the #1 elevator is assignable to a landing call made from 6F to 8F which are located forward of it and the #2 elevator is assignable to a landing call made from 1F to 5F which are located forward of it.

Figure 6:
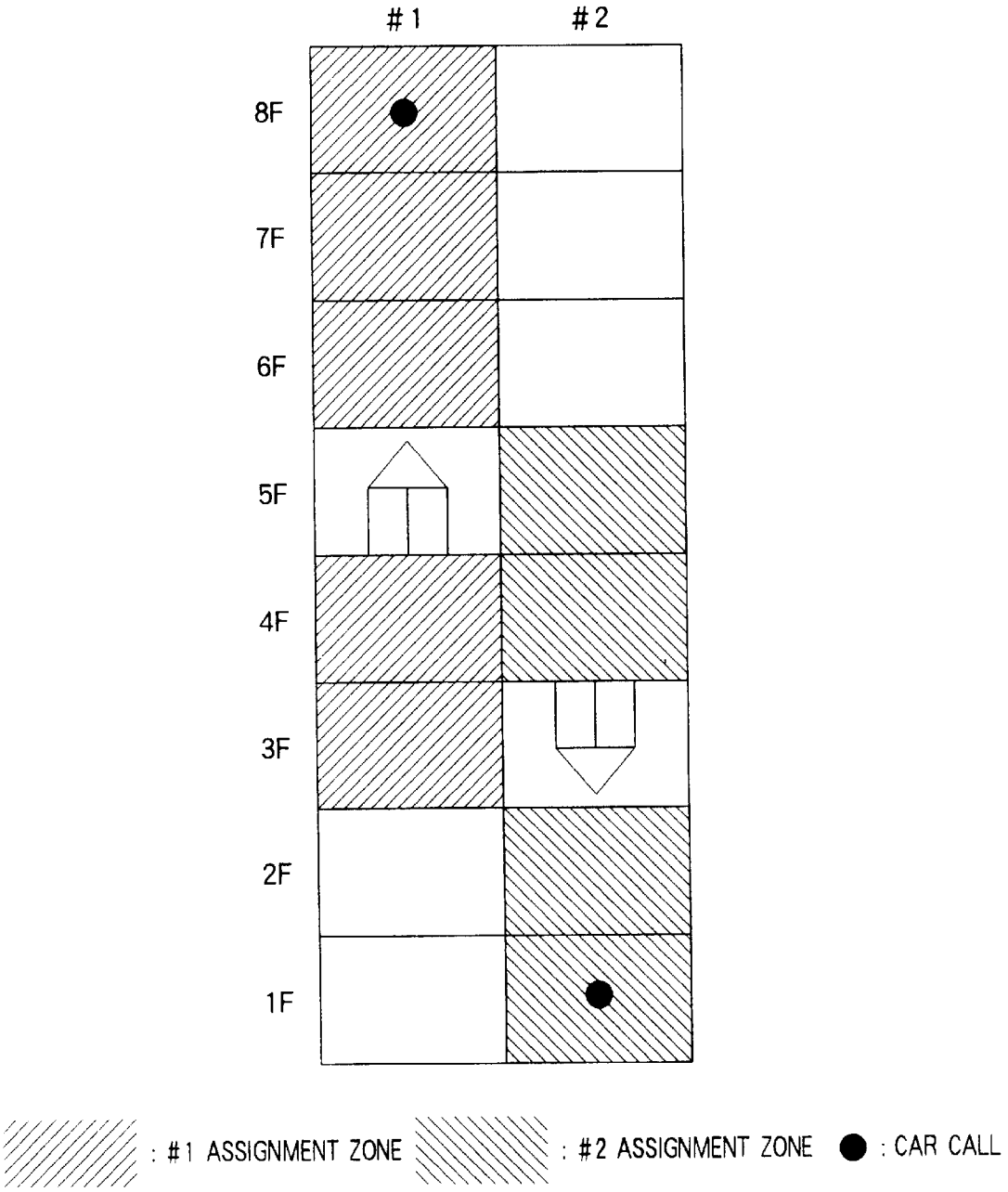
FIG. 6 is a view explaining the assignment zone determination means.

Further, in FIG. 6, the #1 elevator travels upward through 5F with a car call to 8F and the #2 elevator travels downward through 3F with a car call to 1F. In this case, the #1 elevator is assignable to landing calls made from 6F to 8F which are located forward of it and from 3F to 4F which are located backward of both the #1 and #2 elevators and the #2 elevator is assignable to landing calls made from 1F to 2F which are located forward of it and from 4F to 5F which are located backward of both the #1 and #2 elevators. In any case, the direction where the landing calls are made may be any of an UP direction and a DOWN direction.

Figure 7:
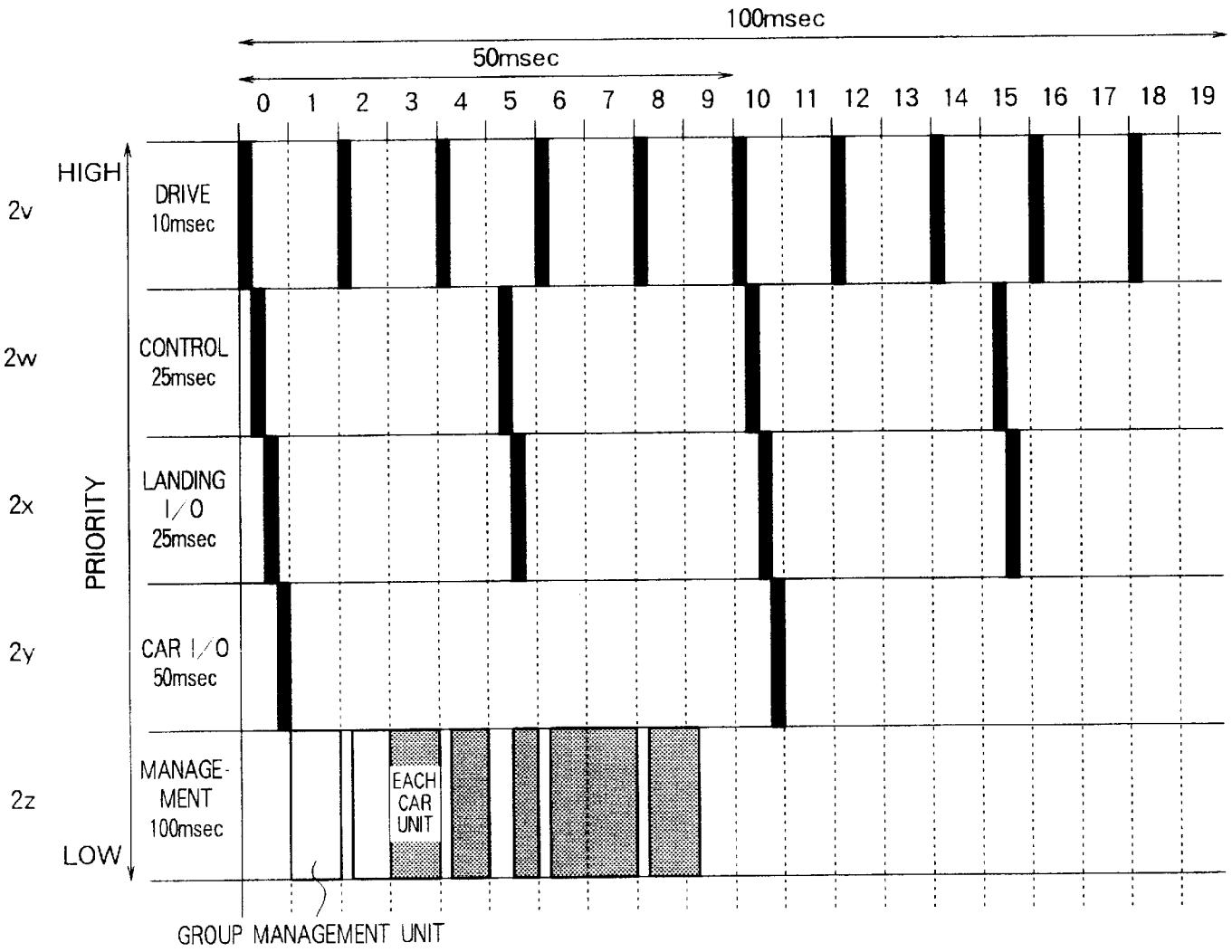
FIG. 7 is a timing chart showing the execution priority of respective tasks to be subjected to arithmetic operation in the control apparatus of the present invention.

Next, FIG. 7 is a timing chart showing the execution priority of respective tasks to be subjected to arithmetic operation in the control apparatus of the present invention. The arithmetic operation executed in the control apparatus is composed of five modules when they are roughly classified and they are represented by the modules 2*v*–2*z* in FIG. 1 as described above.

To describe the modules in the sequence of higher priority, they are composed of the drive module 2*v* subjected to arithmetic operation at each 10 msec. for controlling an inverter and a converter, the control module 2*w* subjected to arithmetic operation at each 25 msec. for creating a velocity pattern and controlling a brake, the landing I/O module 2*x* subjected to arithmetic operation at each 25 msec. for controlling information input to and output from the landing equipment, the car I/O module 2*y* subjected to arithmetic operation at each 50 msec. for controlling information input to and output from the car, and the management module 2*z* subjected to arithmetic operation at each 100 msec. for requesting the start and stop of the car, setting a direction and registering and cancelling a call.

The interior of the management module 2*z* is composed of a group management unit for assigning a call based on information from the other elevator and an each car unit for controlling each car (see 2*z* in FIG. 7) and arithmetic operation is carried out first as to the group management unit and then as to the each car unit.

Next, operation of the elevator control apparatus of the embodiment will be described based on the flowchart of FIG. 8. Note, the operation is executed by a processing device (not shown) composed of a CPU as part of the hardware actually constituting the control apparatus, and the like in accordance with an incorporated program.

First, when it is detected at step ST40 that a new landing call is registered, it is determined at step ST41 whether or not both the #1 and #2 elevators are empty. The empty car described here is a car which has responded to all the calls to which a service is to be tendered and waits at an arbitrary floor with its door open without instruction for its travelling direction.

When both of the two cars are empty, it is determined at step ST42 whether or not the #1 elevator is nearer from the floor where the new car call is made, and when it is nearer therefrom, the landing call is assigned to the #1 elevator at step ST47. Whereas, when the #2 elevator is nearer from the floor, the landing call is assigned to the #2 elevator at step ST49. Further, when both the #1 and #2 elevators are apart from the floor by the same distance, the landing call is assigned to a predetermined car or the #1 elevator.

Next, when any one of the #1 and #2 elevators is empty or both the cars are in operation, it is determined at step ST43 whether or not the new landing call is a forward call with respect to the #1 elevator and is not a forward call with resect to the #2 elevator. Note, the concept of a backward call is not applied to an empty car and calls in both the UP and DOWN directions are regarded as a forward call. When step ST43 is Yes, the landing call is assigned to the #1 elevator at step ST47. When step ST43 is No, it is determined at step ST44 whether or not the new landing call is a backward call with respect to the #2 elevator and is not a backward call with resect to the #1 elevator. When step ST44 is Yes, the landing call is assigned to the #1 elevator at step ST47.

When step ST44 is No, it is determined at step ST45 whether or not the new landing call is a forward call with respect to the #2 elevator and is not a forward call with respect to the #1 elevator. When step ST 45 is Yes, the landing call assigned to the #2 elevator at step ST49. Whereas, when step ST45 is No, it is determined at step ST46 whether or not the new landing call is a backward call with respect to the #1 elevator and is not a backward call with resect to the #2 elevator. When step ST46 is Yes, the landing call is assigned to the #2 elevator at step ST49. When step ST46 is No, the landing call is assigned to both the #1 and #2 elevators at step ST48.

Note, when there is a car which responded to the landing call earlier in the state that the landing call was assigned to both the #1 and #2 elevators, the call response means 2*a* of the car control means 2 of FIG. 2 issues a response signal to the landing call as well as issues a signal for cancelling the assignment of the landing call to the other elevator.

That is, all the calls forward of the own elevator (each car) (up to the highest or lowest floor nearest to it) are assigned by the determination executed at steps ST43 and ST45, all the backward calls common to the own elevator and the other elevator are assigned by the determination No executed at steps ST43, ST45 and the call which is the backward call to the other elevator and the forward call to the own elevator is assigned only to the own elevator and the call which is the backward call of the own elevator and the forward call of the other elevator is assigned only to the other elevator by the determination Yes executed at steps ST43–ST46.

Figure 8:
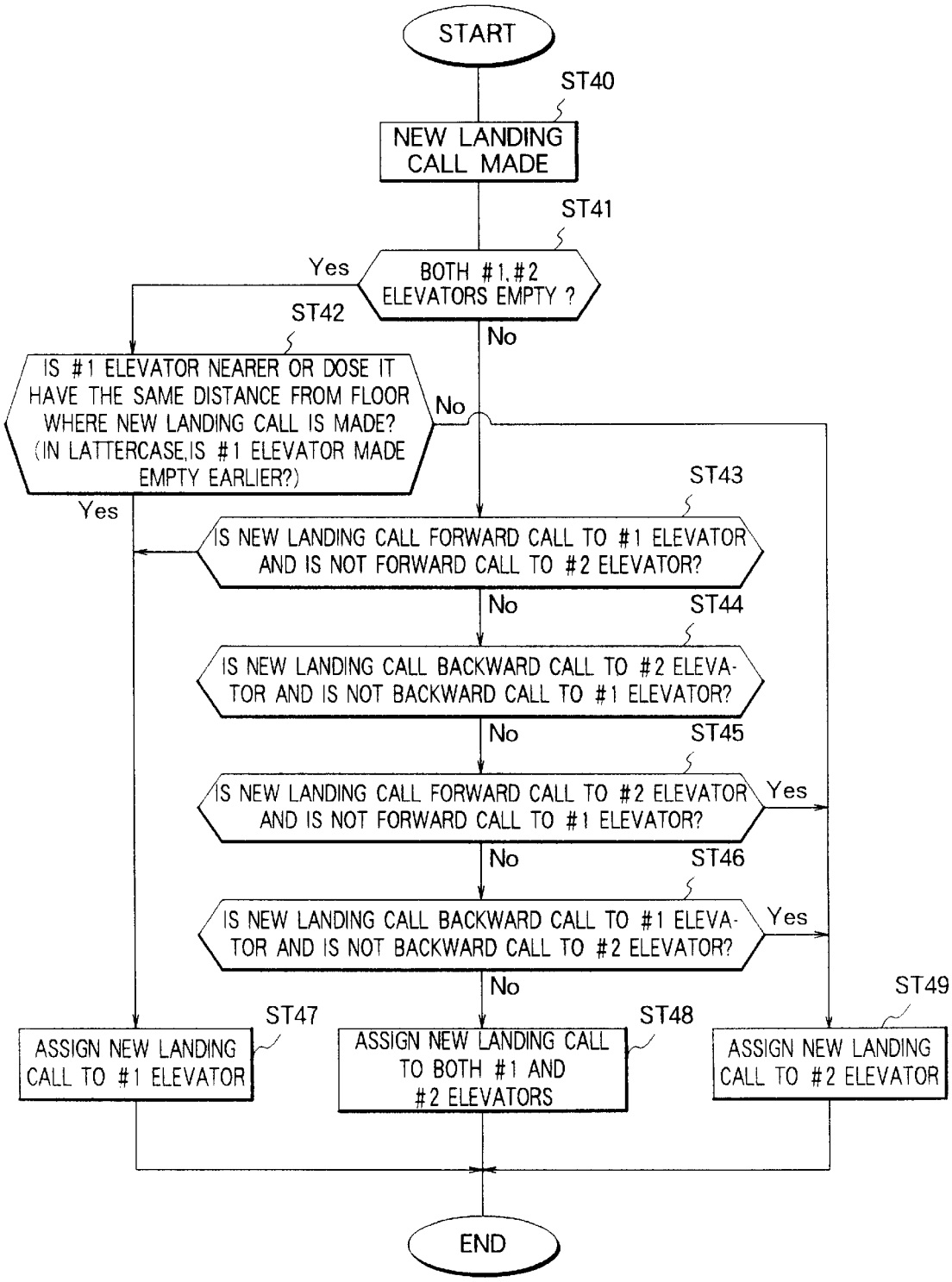
FIG. 8 is a flowchart showing the procedure of the embodiment 1.

Note, the forward call referred to in FIG. 8 is a landing call which is registered to an arbitrary floor in the same direction as the travelling direction of a car with respect to the present position thereof and the backward call is a landing call which is registered to an arbitrary floor in the direction opposite to the travelling direction of a car with respect to the present position thereof. Note, a call made on a floor through which a car is travelling or from which the car starts and where it can stop is included in the backward call. Further, although the flowchart describes a case that the new landing call is made, it is rightfully applicable to a case that the assignment of the new landing call is periodically reviewed at the timing at which the travelling direction of a car is reversed or the like even after the new landing call is made to prevent unnatural movement on an indicator installed to a landing.

Next, the embodiment will be described as to an example of a case that a call is assigned in accordance with the procedure of FIG. 8 based on FIG. 9–FIG. 16. In the respective drawings, a black triangle represents a landing call, a white triangle represents an assignment call and a black circle represents a car call.

Figure 9:
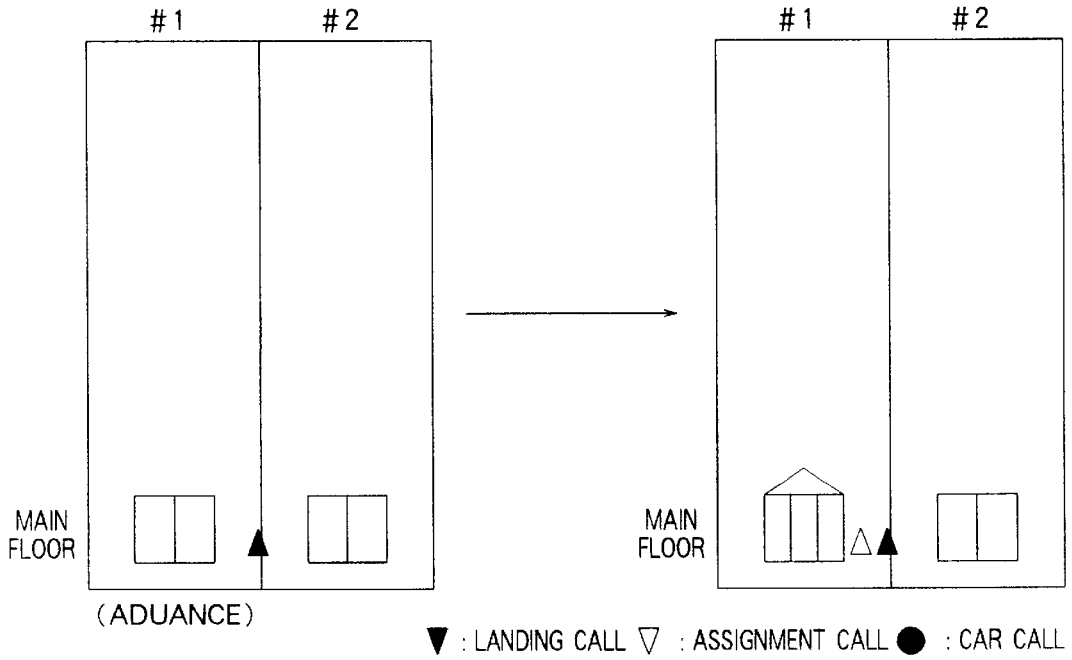
FIG. 9 is a view explaining the operation of the embodiment 1.
Figure 10:
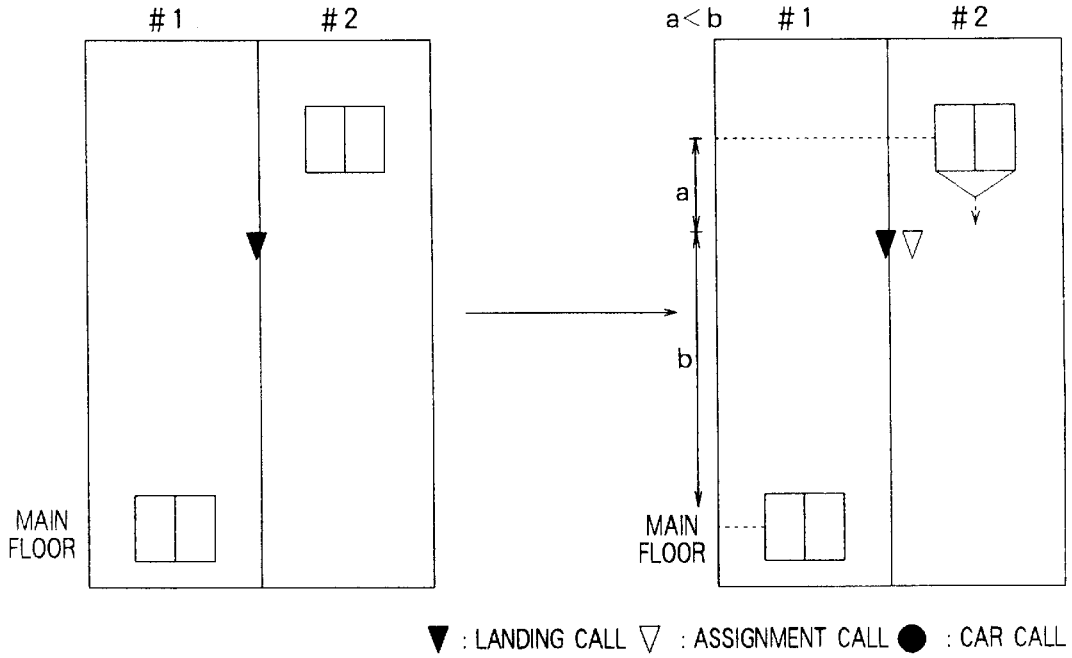
FIG. 10 is a view explaining the operation of the embodiment 1.

First, FIG. 9 and FIG. 10 will describe an example of an assignment executed when two cars are empty. FIG. 9 shows an example that a landing call in an upward direction is registered when the two cars wait at a main floor. In this case, one of the #1 and #2 elevators which was made empty first is stored as an advance car to, for example, the memory 2*m* of the car control means 2 of FIG. 2. Then, when a call is made at the floor where the two cars wait, the call is assigned to the advance car (the #1 elevator in this case). Note, in this case, the condition described in parentheses (was the #1 elevator made empty first when the distance is the same?) must be added at step ST42 of FIG. 8.

FIG. 10 shows a case that a landing call is made when the two cars wait at a different floor. In this case, the landing call is assigned to the #2 elevator waiting at the floor which is nearer from the floor where the landing call is registered. Which of the two cars are nearer to the floor can be determined from, for example, the positions of the cars which were stored in the memory 2*m* of the car control means 2 of FIG. 2 when they stopped.

Figure 11:
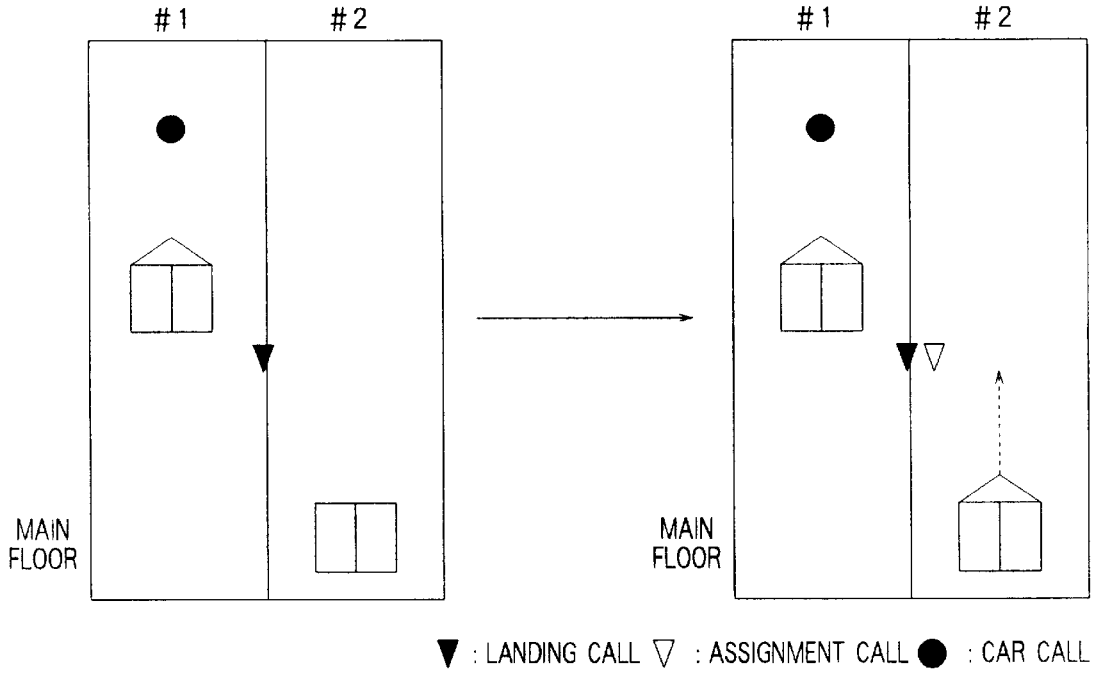
FIG. 11 is a view explaining the operation of the embodiment 1.
Figure 12:
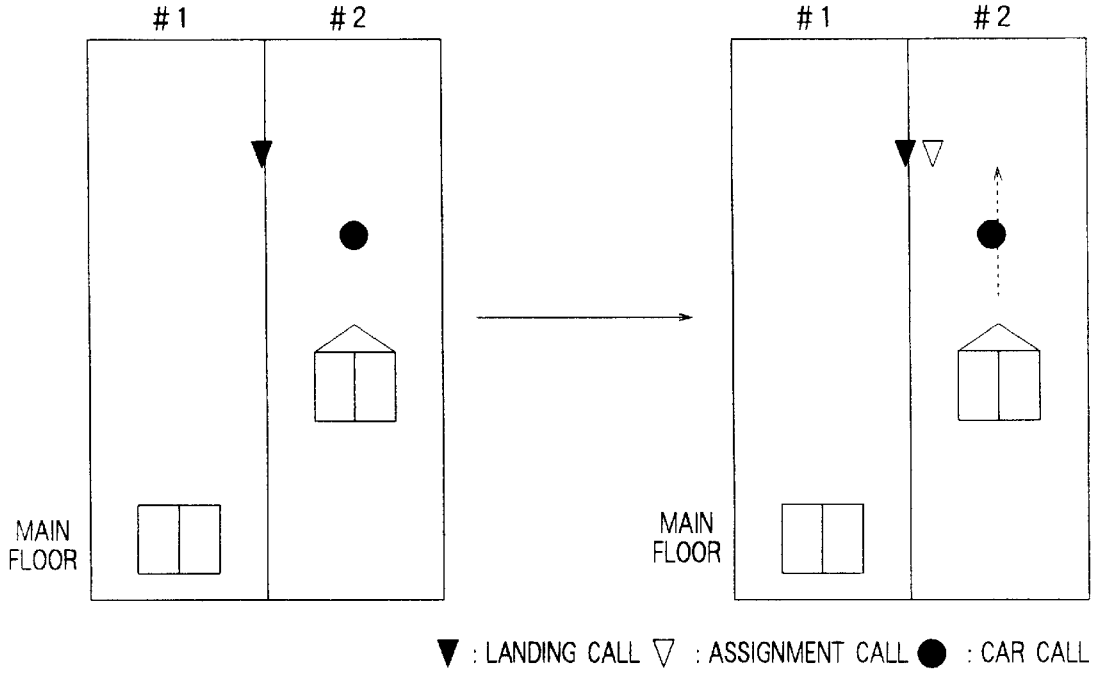
FIG. 12 is a view explaining the operation of the embodiment 1.

FIG. 11 and FIG. 12 describe an example of assignment when one of the cars waits and the other of them travels. FIG. 11 shows an example that a landing call is made backward of the car travelling with a service direction. When a down landing call is registered backward of the #1 elevator travelling upward, since the call is a backward call with respect to the #1 elevator, it is assigned to the waiting #2 elevator.

FIG. 12 shows an example that a landing call (the direction of the call is not a matter) is made forward of the car travelling with a service direction. When a down landing call is registered forward of the #2 elevator travelling upward, since the call is a forward call with respect to the #2 elevator, it is assigned to the #2 elevator as it is.

Figure 13:
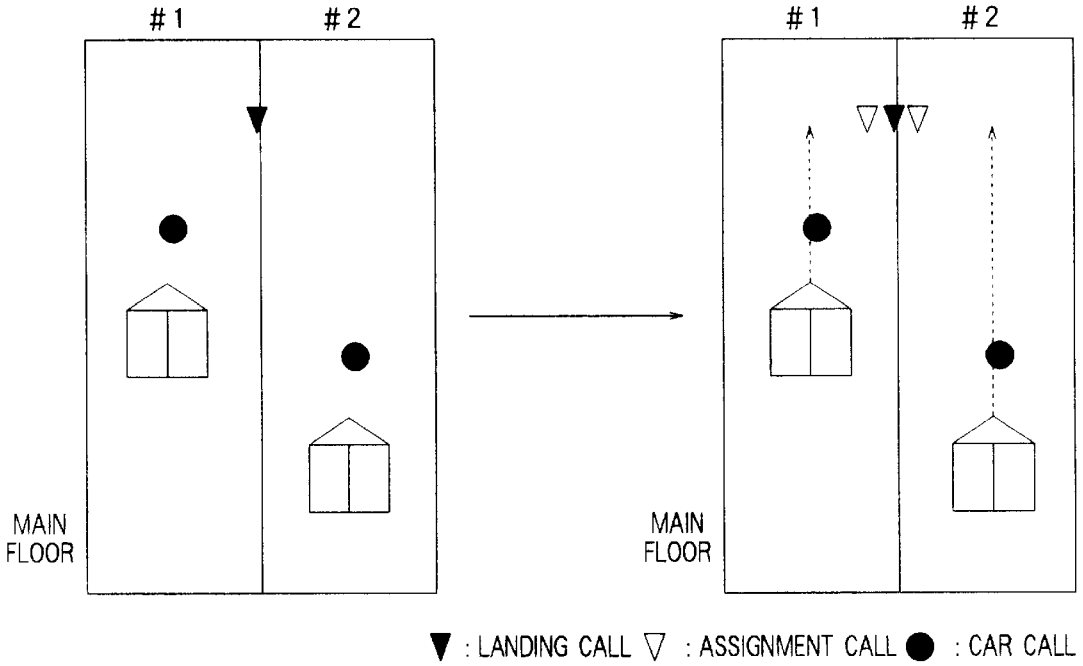
FIG. 13 is a view explaining the operation of the embodiment 1.
Figure 14:
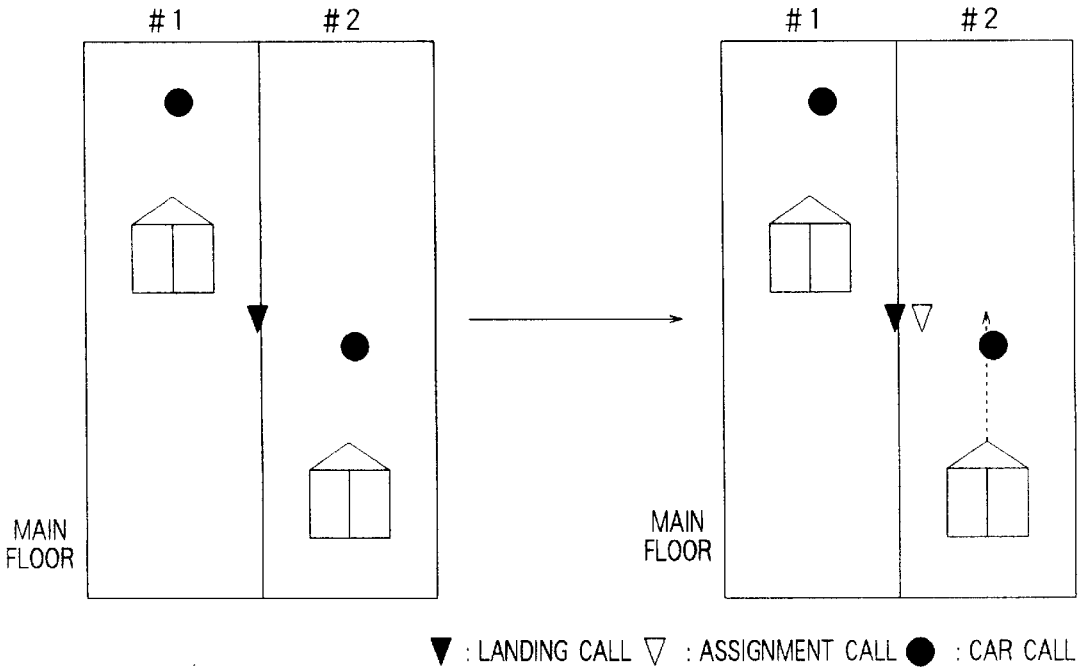
FIG. 14 is a view explaining the operation of the embodiment 1.

FIG. 13 and FIG. 14 describe an example of assignment when the two cars travel. FIG. 13 is an example when both the two cars travel in the same direction and a call is made forward of the two cars. Since a down landing call is registered forward of both the #1 and #2 elevators in this case, the landing call is not assigned to any one of the cars but assigned to both of them.

FIG. 14 shows an example that the two cars travel in the same direction and a call is made forward of one of the cars and backward of the other elevator. Since a down landing call is registered backward of the #1 elevator and forward of the #2 elevator in this case, it is assigned to the #2 elevator.

Figure 15:
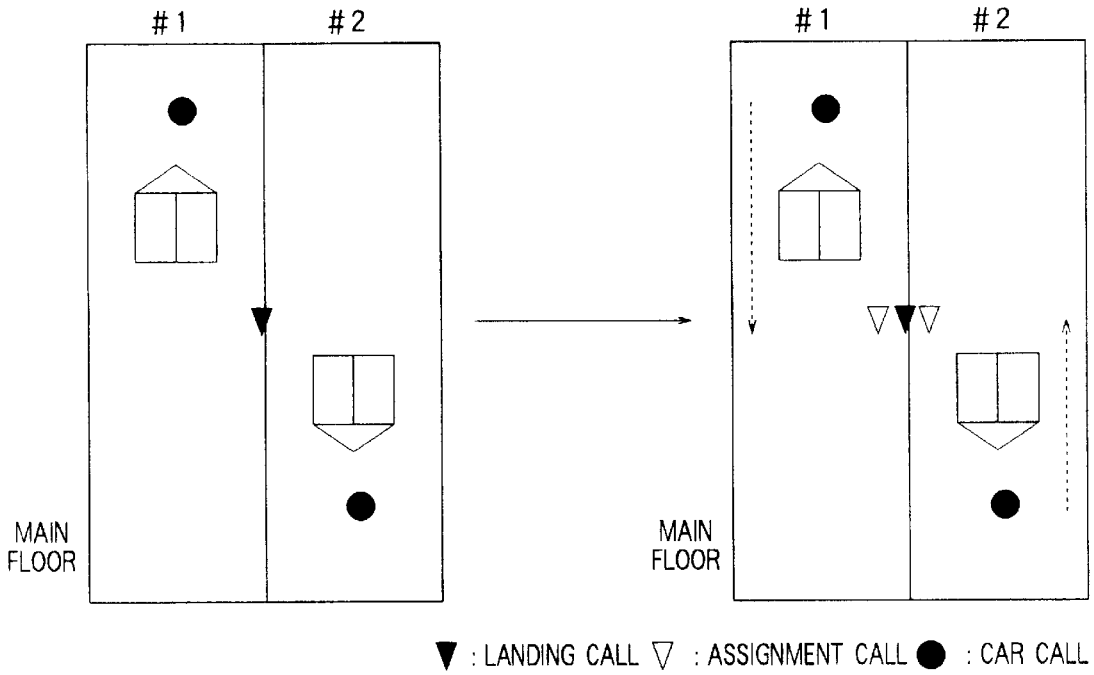
FIG. 15 is a view explaining the operation of the embodiment 1.
Figure 16:
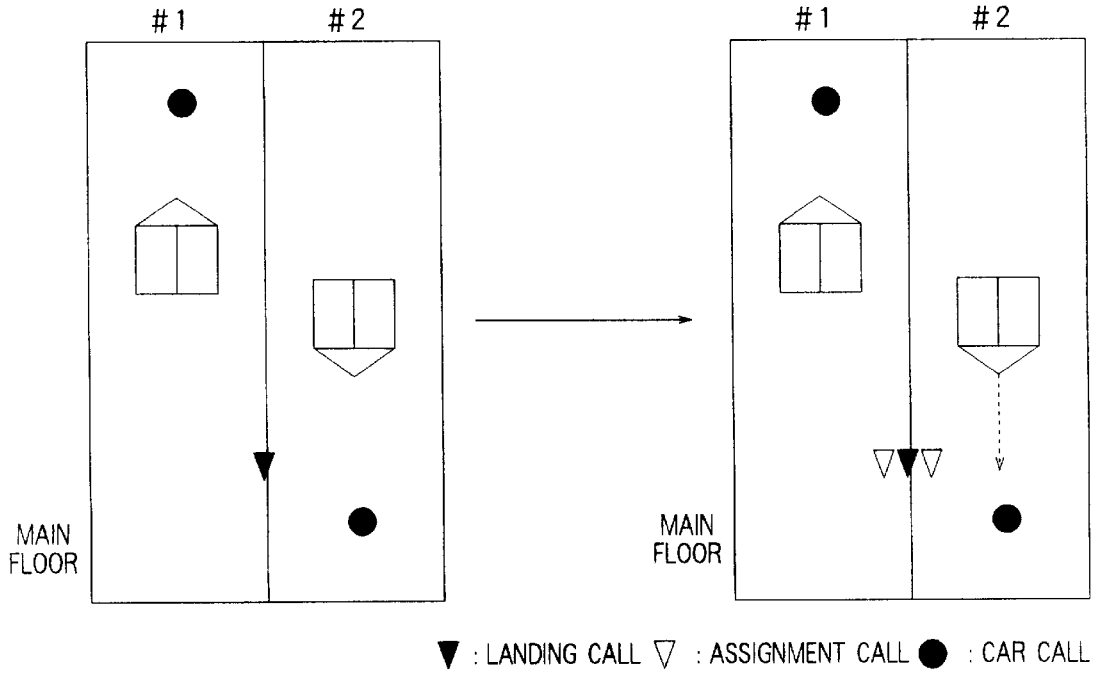
FIG. 16 is a view explaining the operation of the embodiment 1.

Next, FIG. 15 and FIG. 16 describes an example of assignment when the two cars travel. FIG. 15 shows an example that a call is made when one of the cars travels upward and the other elevator travels downward. Since a down landing call is registered backward of both the cars in this case, the landing call is assigned to the two cars. FIG. 16 shows an example that a call is made forward of the other of the two cars when one of the cars travels upward and the other elevator travels downward. Since the registered down landing call is made backward of the #1 elevator and forward of the #2 elevator, it is assigned to the #2 elevator.

Embodiment 2

Figure 17:
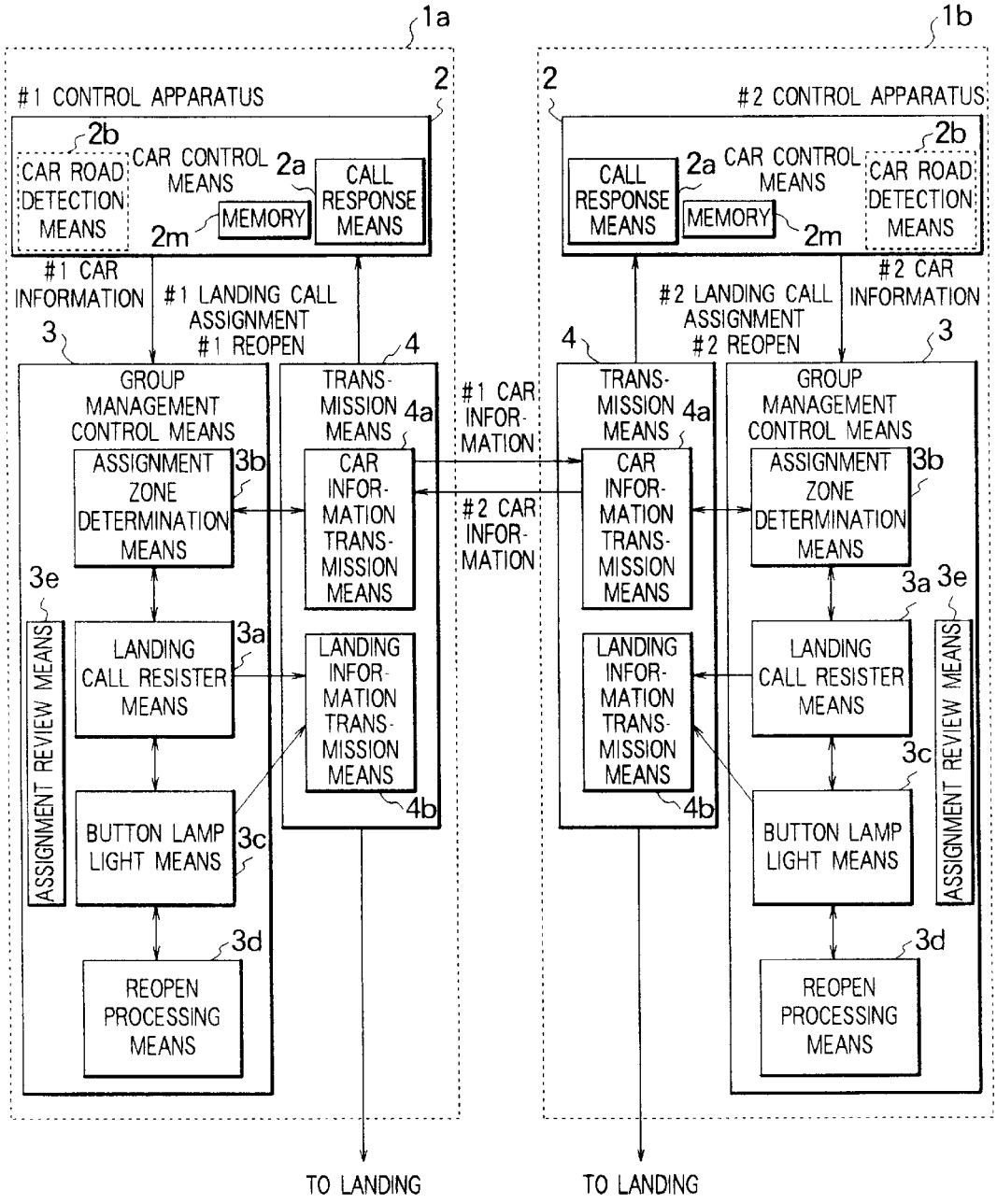
FIG. 17 is a block diagram showing the arrangement of a control apparatus for explaining the operation of an embodiment 2.

Next, an elevator control apparatus according to another embodiment of the present invention will be described based on the arrangement of FIG. 17. FIG. 17 is a view showing the arrangement of the elevator control apparatus according to the another embodiment of the present invention, wherein numeral 3*e* denotes assignment review means (assignment means for coping with indicator) for executing assignment in consideration of an indicator installed to a landing (see the landing unit 8 of FIG. 1). Portions other than the above are the same as those shown in the arrangement view of FIG. 2.

That is, when a passenger observes the indicator installed at the landing, if, for example, a car located away from a floor where a landing call is made is caused to respond to the landing call, the passenger may feel unnatural as to the movement of the car. Further, the embodiment reduces such a chance that the indicator indicates that a car is caused to respond to the forward call of the other elevator regardless of that the car is made empty and as if the car and the other elevator travel in the same direction at the same time. Particularly, in the latter case, responsiveness to a call which will be newly made can be enhanced by positively causing the empty car to wait at the location where it is made empty.

Next, the procedure of the control apparatus of the embodiment will be described based on the flowchart of FIG. 18. The procedure described here relates to the assignment of a landing call and intends to prevent a passenger from feeling strange when he or she observes the indicator of a landing unit 8 by executing the assignment by reflecting the change of the state of cars caused by the movement thereof after a call is made, different from the assignment in the embodiment 1 which is executed based on the state of the cars just after a call is made. This procedure is executed by the assignment review means.

First, a timing at which the assignment of a landing call is reviewed is detected at step ST100. The review of assignment described here is a processing for changing assignment by reviewing the assignment of a landing call at each predetermined period so as to optimize the assignment of the landing call in accordance to changing circumstances. The predetermined period may be each 100 msec. shown in FIG. 7 or it is ideal to set the period shorter than the shortest travelling time of the elevator, that is, a time shorter than intervals of about 5 seconds.

It is determined at step ST101 whether or not an own elevator stops in response to a final car call, and when the own elevator does not stop in response thereto, assignment is not reviewed. Whereas, when the own elevator responds to the final car call, it is determined at step ST102 whether or not there is an assignment call forward of the own elevator. When there is no assignment call, the assignment is not reviewed. Then, it is determined at step ST103 whether or not there is an assigned call forward of the other elevator, and when it is located forward of the other elevator, the assignment to the own elevator is cancelled at step ST104, whereas it is not located forward of the other elevator, the assignment to the own elevator is continued at step ST105.

Figure 19:
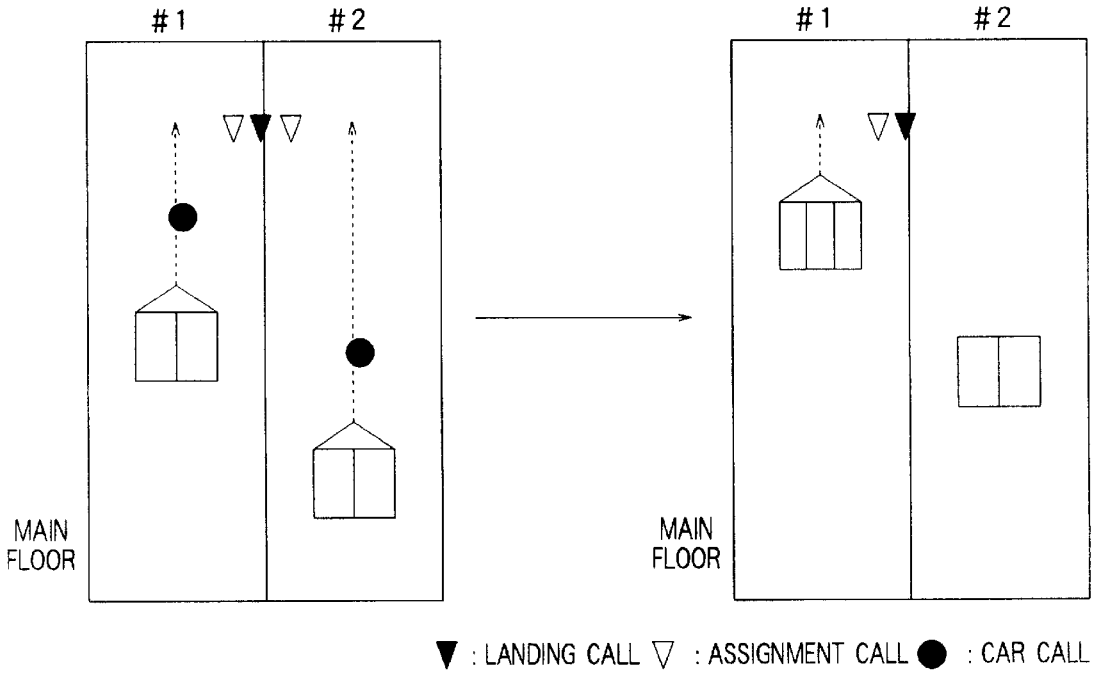
FIG. 19 is a view explaining the operation of the embodiment 2.
Figure 20:
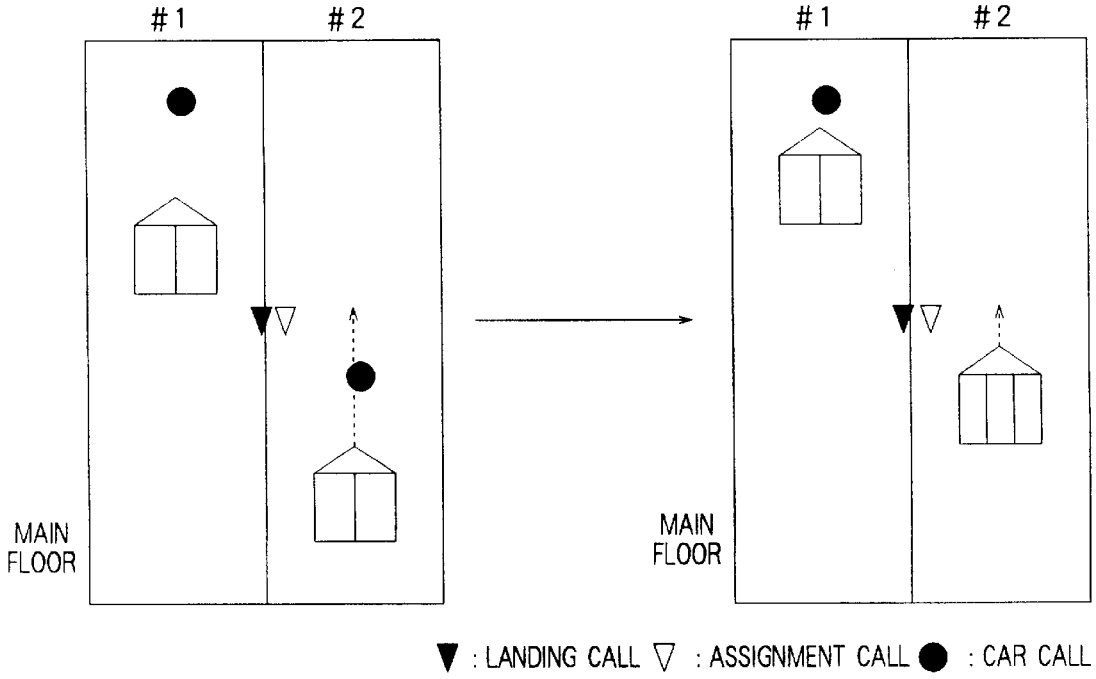
FIG. 20 is a view explaining the operation of the embodiment 2.

Operation of the cars based on the procedure described with reference to FIG. 18 will be described based on FIG. 19 and FIG. 20. FIG. 19 shows a case that there is a landing call forward of two cars and the landing call is assigned to them. In this case, when, for example, the #2 elevator travelling on the lower side responds first to a car call, since there is the landing call forward of the #1 elevator, after the #2 elevator responds to the final car call, the assignment of the landing call to the #2 elevator is cancelled and the #2 elevator is made empty. Since the #2 elevator is made empty, it can respond to a landing call which will be made next at once, thus a passenger observing the indicator understands that an effective service is tendered as a whole. Further, even if the #2 elevator responds to the final car call in FIG. 20, since there is the landing call backward of the #1 elevator, the assignment of the landing call is continued as it is.

Figure 18:
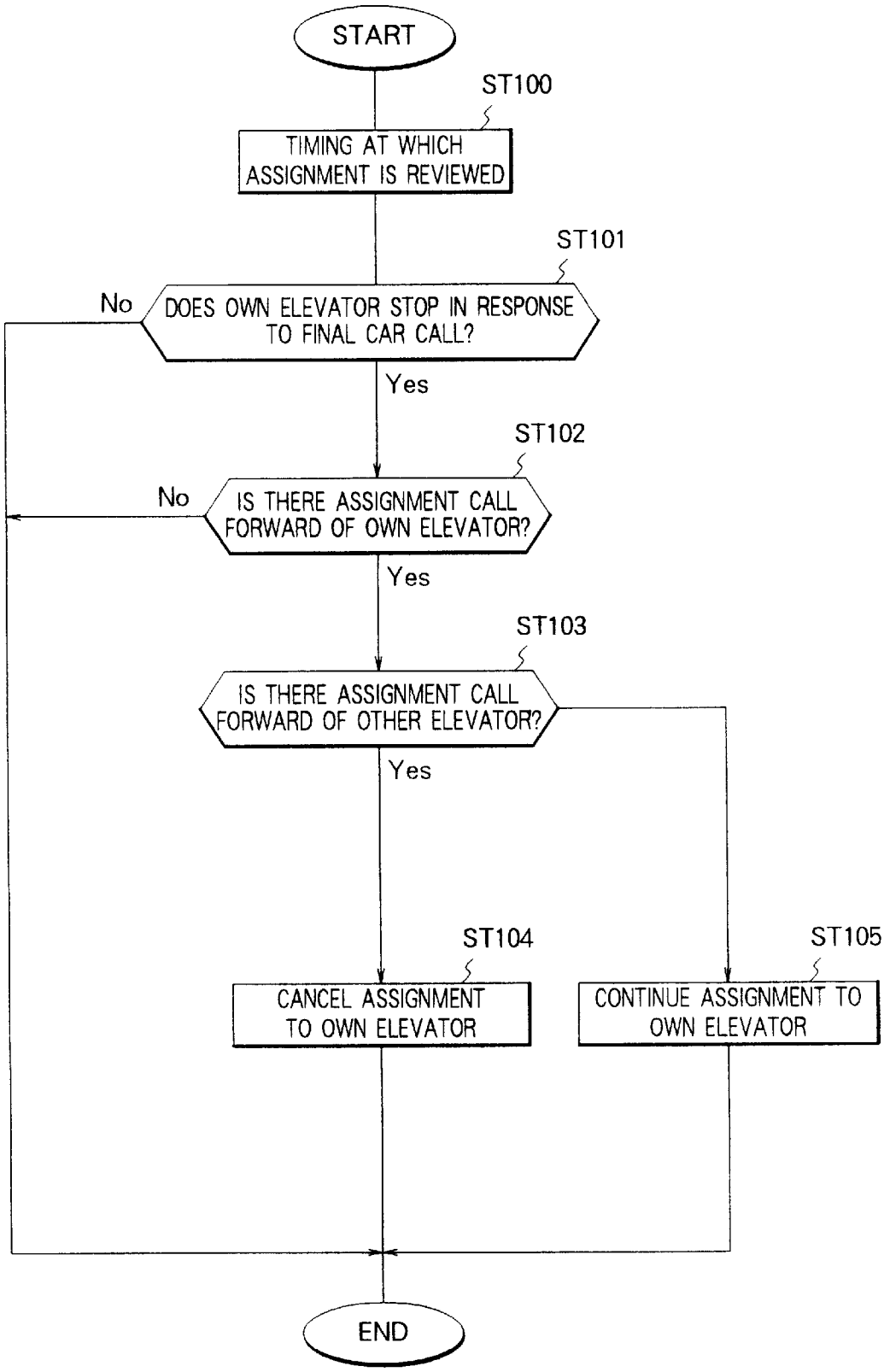
FIG. 18 is a flowchart showing the procedure of the embodiment 2.

Note, although whether or not the own elevator stops in response to the final car call is used as a condition for reviewing nor not reviewing the assignment as shown at step ST101 of FIG. 18 here, the same advantage can be obtained even if the review is executed based on a condition, for example, that when a car load is detected, it is found that there is no passenger in the car, that is, no load is imposed on the car in place of the above condition.

As an example of the above-mentioned, there may be employed a condition, for example, that no load is imposed in the car and the door of the car is closed as one of the conditions for determining whether the review is to be executed or not. Whether any load is imposed in the car or not is detected by disposing car load detection means 2*b* to be described later as shown by the broken line in FIG. 17 and whether the door of the car is opened or not is detected from an existing control signal. Unless no load is imposed in the car, there is a possibility that a passenger remaining in the car registers a car call later, which is not caused after the door is closed.

Another example employs a condition that when a response is made to a final car call, there is no landing call at the floor. Since a car usually travels when the response is made to the final car call and it is before the car starts deceleration by the response as well as it is anticipated that all the loads are removed from the car when no landing call is made on the floor, the assignment can be reviewed at an early timing before the car arrives at the floor.

Embodiment 3

Figure 21:
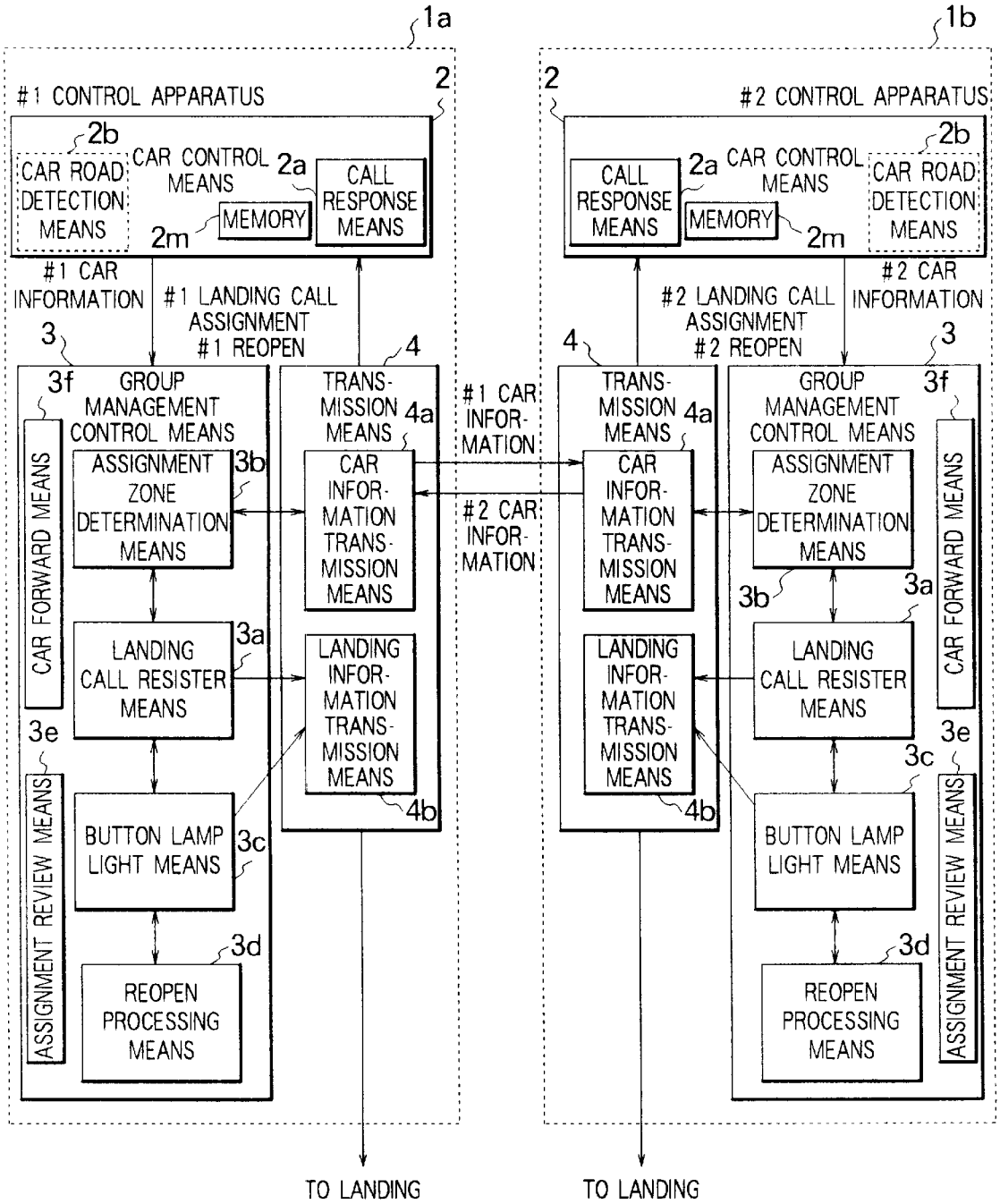
FIG. 21 is a block diagram showing the arrangement of a control apparatus for explaining the operation of an embodiment 3.

Next, an elevator control apparatus according to still another embodiment of the present invention will be described based on the arrangement view of FIG. 21. FIG. 21 is a view showing the arrangement of the elevator control apparatus according to the still another embodiment of the present invention, wherein numeral 2*b* denotes car load detecting means composed of a balance for detecting the load of passengers got in a car, numeral 3*f* denotes a car forward means for forwarding a car to a predetermined floor when a crush is detected. Portions other than the above are the same as those shown in the arrangement view of FIG. 17. That is, the embodiment is arranged by further adding a forward function to the arrangement of the embodiment 2.

Figure 22:
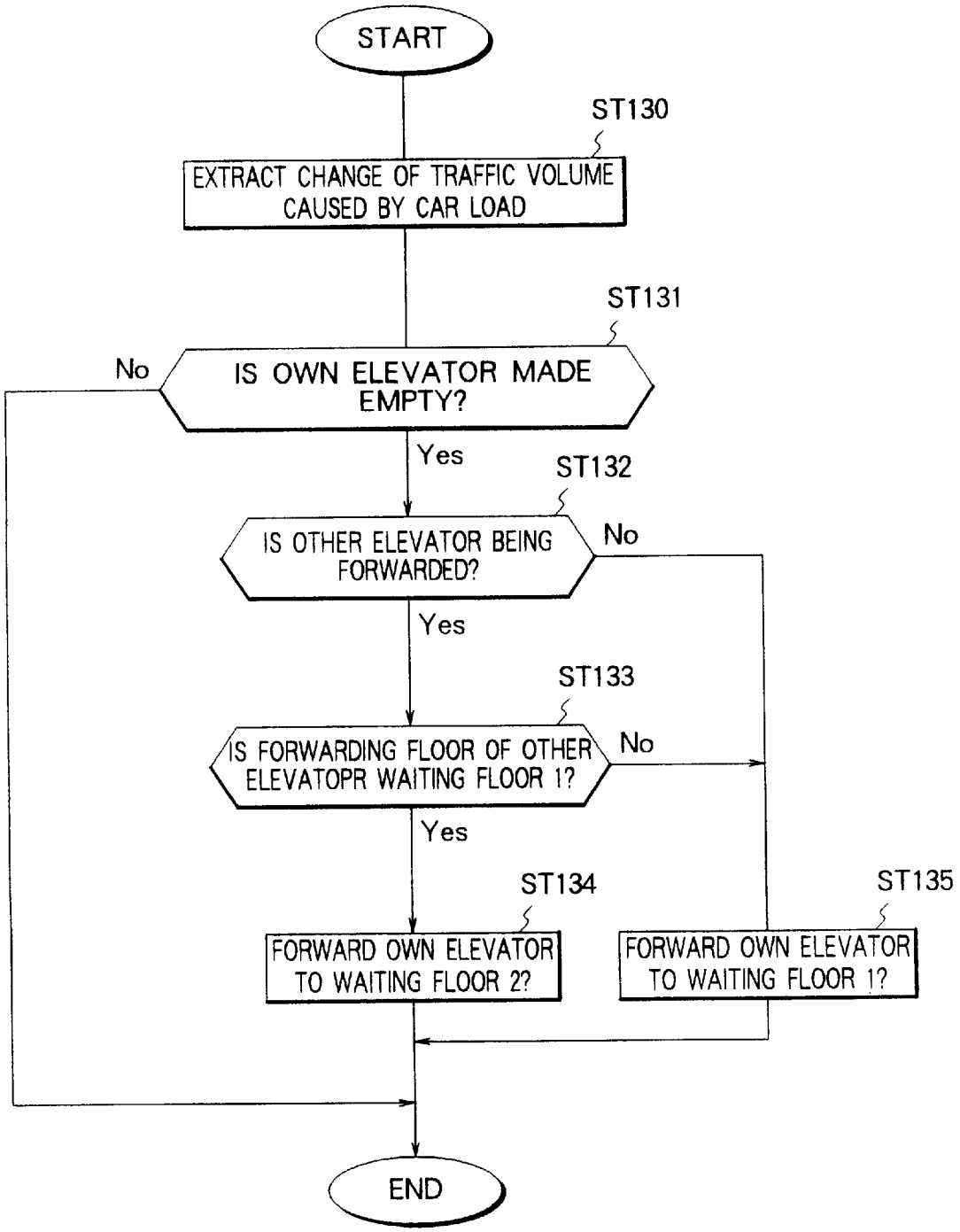
FIG. 22 is a flowchart showing the procedure of the embodiment 3.

Next, the processing procedure of the controller of the embodiment will be described based on the flowchart of FIG. 22. Means for preventing the deterioration of a service in a crush will be described here and this means can be embodied by the combination of the car load detection means 2*b* and the car forward means 3*f*.

The change of a traffic volume caused by a car load is extracted at step ST130. This is executed by detecting that passengers more than a predetermined value got in a car by the car load detection means 2*b* disposed in the car. It is contemplated that this state will be caused, for example, in such a case that a crush arises in a downward direction from resident floors to an entrance floor in an intermediate-rise housing and the like at an attendance time in the morning. Note, an operation pattern is conventionally changed based on the extraction of the change of a traffic volume and the extraction thereof itself is well known.

Next, it is determined at step ST131 whether or not an own elevator is made empty, and when the car is made empty, it is determined at step ST132 whether or not the other elevator is being forwarded. When the car is not being forwarded, the own elevator is forwarded to a predetermined waiting floor 1 at step ST135. When the other elevator is being forwarded, it is determined at step ST133 whether or not the floor to which the other elevator is being forwarded is the waiting floor 1, and when it is the waiting floor 1, the own elevator is forwarded to a waiting floor 2 at step ST134, whereas when it is the waiting floor 2, the own elevator is forwarded to the waiting floor 1 at step ST135.

That is, when the load detection means 2*b* detects that there is executed such an operation pattern that passengers get in the car on the resident floors and get off the car on the entrance floor and the all the loads are removed from the car there, although the assignment of a call is usually reviewed as described in the embodiment 2 when the car is made empty at the entrance floor, the car is forwarded to the predetermined floor once before the review and thereafter the review is executed.

Figure 23:
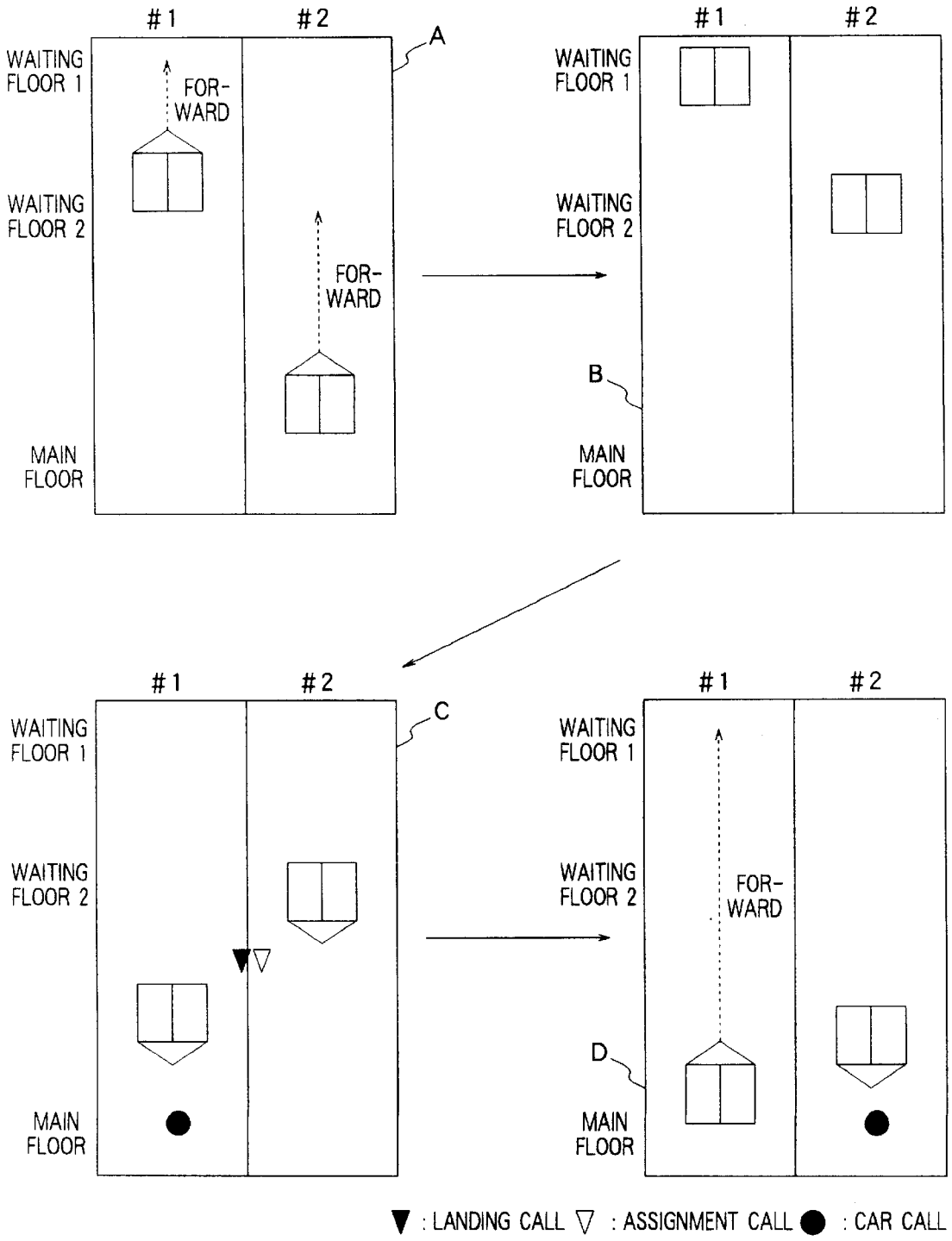
FIG. 23 is a view explaining the operation of the embodiment 3.

Next, the specific operation of the embodiment 3 based on the flowchart of FIG. 22 will be described based on the flowchart of FIG. 23. There will be described here a case that two sets of cases are forwarded to the predetermined waiting floors 1 and 2. In FIG. 23A, the #1 elevator is forwarded to the waiting floor 1 and the #2 elevator is forwarded to the waiting floor 2, respectively. In FIG. 23B, the #1 elevator waits at the waiting floor 1 and the #2 elevator waits at the waiting floor 2, respectively. In FIG. 23C, a landing call made on a midway floor is assigned in accordance with a predetermined evaluation procedure. Finally, the cars responded to a final car call are forwarded to the next waiting floor, respectively in FIG. 23D. Here, the #1 elevator is forwarded to the waiting floor 1 after it responds to the final car call at a main floor.

Note, the present invention is not limited to the above respective embodiments. Although the case of the two cars is described in the above embodiments, the present invention is also applicable to a case in which two or more cars are used by the same means. Further, although the embodiment 3 describes the case that the crush arises in the downward direction, the present invention is also applicable to a case that the crush arises in an upward direction.

Industrial Applicability

As described above, according to the first to third inventions of the present invention, in the elevator control apparatus for controlling the cars of at least two elevators in which a group management device is abolished, the elevator control apparatus provided with each of the cars of the plurality of elevators whose operation is managed as one group and comprises car control means for controlling the operation of respective elevator cars, car information transmission means for transmitting information such as car location, car direction, car load, the state of occurrence of car call and the like between an own elevator and other elevators, landing information transmission means for transmitting information to landing equipment disposed to a landing such as landing buttons, a landing indicator, a hall lantern and the like, and group management control means for determining an assignment zone assigned to the own elevator based on car information including the car position and the travelling direction of the own elevator and the other elevators obtained from the car control means and the car information transmission means and assigning a landing call made in the assignment zone of the own elevator to it based on the landing information from the landing information transmission means. Further, the elevators are caused to wait when a near car is assigned or there is no call to be responded. As a result, since the elevators respond to a landing call made backward thereof one another with a simple arrangement, there can be obtained the advantage of the provision of the elevator control apparatus which enables a service of a level as high as that achieved when a universal group management device is installed to be obtained by less expensive means, and the like.

According to the fourth to seventh inventions of the present invention, since there is further provided an assignment review means which, after it is decided that the own elevator is assigned to the call to respond to it, reviews the assignment each time a landing call is made if the state of the own elevator satisfies a predetermined condition, there can be obtained such an advantage of preventing a passenger from feeling strange when he or she observes the indicator of a landing unit by executing the assignment by reflecting the change of the state of cars caused by the movement thereof after a call is made, different from the assignment which is executed based on the state of the cars just after a call is made.

Further, according to the eighth to the tenth inventions of the present invention, since there is further provided car forward means for forwarding, when the car load detection means detects that loads got on the car at one or a plurality of predetermined floors exceed a predetermined value, the car to a predetermined waiting floor before the assignment review means reviews assignment, there can be obtained the advantage of solving a crush which arises, for example, in a downward direction from resident floors to an entrance floor in an intermediate-rise housing and the like at an attendance time in the morning by improving a transportation effect, and the like.

We claim:

1. An elevator control system wherein each car of a plurality of elevator cars, managed as a single elevator group, includes an individual elevator control apparatus for controlling each car, the elevator control apparatus comprising:

car control means for controlling operation of an elevator car;

car information transmission means for transmitting information, including car location, car direction, car load, and an occurrence of a car call, between a first elevator controlled by a first elevator control apparatus and other elevators, each of the other elevators being controlled by an additional elevator control apparatus;

landing information transmission means for transmitting information to landing equipment located at a landing including landing buttons, a landing indicator, and a hall lantern; and group management control means comprising assignment zone determination means for determining a first assignment zone assigned to the first elevator, based on car information including car position and travelling direction of the first elevator car and the other elevator cars, obtained from said car control means and said car information transmission means, the first assignment zone comprising a subset of floors in a building to which the first elevator is assigned landing calls, independent of assignment of landing calls to the other elevators, the group management control means assigning a landing call made in the assignment zone of the first elevator to the first elevator based on the landing information from said landing information transmission means.

2. The elevator control system according to claim 1, wherein the first assignment zone includes floors ranging from a floor where a car of the first elevator is located to a final floor located forward of a travelling direction of the first elevator and floors located backward of the travelling direction of the first elevator and further located backward of car positions of the other elevators in the traveling direction of the other elevators.

3. The elevator control system according to claim 1, wherein the car control means includes call response means, and, when the first elevator responds first to a landing call assigned to a plurality of elevators, the call response means issues a response signal to the landing call and issues a signal to the other elevators to cancel the landing call assigned to the other elevators.

4. The elevator control system according to claim 1, wherein the group management control means includes assignment review means and, when the group management control means determines that the first elevator is assigned to respond to a call, the assignment review means reviews assignments each time a landing call is made if a state of the first elevator satisfies a first condition.

5. An elevator control apparatus associated with each car of a plurality of elevators managed as one group, the apparatus comprising:

car control means for controlling operation of respective elevator cars;

car information transmission means for transmitting information including car location, car direction, car load, and an occurrence of a car call between a first elevator and other elevators controlled by the elevator control apparatus;

landing information transmission means for transmitting information to landing equipment located at a landing including landing buttons, a landing indicator, and a hall lantern;

group management control means for determining an assignment zone assigned to the first elevator based on car information including car position and travelling direction of the first elevator and the other elevators obtained from the car control means and said car information transmission means and assigning a landing call made in the assignment zone of the first elevator to the first elevator based on the landing information from said landing information transmission means, wherein the group management control means includes assignment review means wherein, when the group management control means determines that the first elevator is assigned to respond to a call, the assignment review means reviews assignments each time a landing call is made if a state of the first elevator satisfies a first condition, and the car control means includes a car load detection means for detecting passenger weight in the car of the first elevator and wherein the first condition of the first elevator in the assignment review means is a condition wherein the interior of the car of the first elevator is not loaded and the door of the car of the first elevator is closed.

6. An elevator control apparatus associated with each car of a plurality of elevators managed as one group, the apparatus comprising:

car control means for controlling operation of respective elevator cars;

car information transmission means for transmitting information including car location, car direction, car load, and an occurrence of a car call between a first elevator and other elevators controlled by the elevator control apparatus;

landing information transmission means for transmitting information to landing equipment located at a landing including landing buttons, a landing indicator, and a hall lantern;

group management control means for determining an assignment zone assigned to the first elevator based on car information including car position and travelling direction of the first elevator and the other elevators obtained from the car control means and said car information transmission means and assigning a landing call made in the assignment zone of the first elevator to the first elevator based on the landing information from said landing information transmission means, wherein the group management control means includes assignment review means wherein, when the group management control means determines that the first elevator is assigned to respond to a call, the assignment review means reviews assignments each time a landing call is made if a state of the first elevator satisfies a first condition, and the car control means includes car load detection means for detecting passenger weight in the car of the first elevator and wherein the first condition of the first elevator in the assignment review means is a condition wherein when a response is made to a final car call, there is no landing call on the floor.

7. An elevator control apparatus associated with each car of a plurality of elevators managed as one group, the apparatus comprising:

car control means for controlling operation of respective elevator cars;

car information transmission means for transmitting information including car location, car direction, car load, and an occurrence of a car call between a first elevator and other elevators controlled by the elevator control apparatus;

landing information transmission means for transmitting information to landing equipment located at a landing including landing buttons, a landing indicator, and a hall lantern;

group management control means for determining an assignment zone assigned to the first elevator based on car information including car position and travelling direction of the first elevator and the other elevators obtained from the car control means and said car information transmission means and assigning a landing call made in the assignment zone of the first elevator to the first elevator based on the landing information from said landing information transmission means, wherein the group management control means includes assignment review means wherein, when the group management control means determines that the first elevator is assigned to respond to a call, the assignment review means reviews assignments each time a landing call is made if a state of the first elevator satisfies a first condition, and the assignment review means cancels the assignment of the first elevator located forward of the travelling direction of the first elevator and forward of the travelling direction the other elevators.

8. An elevator control apparatus associated with each car of a plurality of elevators managed as one group, the apparatus comprising:

car control means for controlling operation of respective elevator cars;

car information transmission means for transmitting information including car location, car direction, car load, and an occurrence of a car call between a first elevator and other elevators controlled by the elevator control apparatus;

landing information transmission means for transmitting information to landing equipment located at a landing including landing buttons, a landing indicator, and a hall lantern;

group management control means for determining an assignment zone assigned to the first elevator based on car information including car position and travelling direction of the first elevator and the other elevators obtained from the car control means and said car information transmission means and assigning a landing call made in the assignment zone of the first elevator to the first elevator based on the landing information from said landing information transmission means, wherein the group management control means includes assignment review means wherein, when the group management control means determines that the first elevator is assigned to respond to a call, the assignment review means reviews assignments each time a landing call is made if a state of the first elevator satisfies a first condition, and the car control means includes car load detection means for detecting passenger weight in the car of the first elevator, and the group management control means includes car forwarding means for forwarding the car of the first elevator to a waiting floor when the car load detection means detects that loads entering the car of the first elevator at one or a plurality of floors exceed a value, before the assignment review means reviews assignments, and, after the car of the first elevator is forwarded to the waiting floor, the assignment review means reviews assignment of the call.

9. The elevator control apparatus according to claim 8, wherein, when the car of a second elevator controlled by the elevator control apparatus is forwarded toward a first waiting floor, the forwarding means does not forward the first elevator to the first waiting floor.

10. The elevator control apparatus according to claim 8, wherein, when the car of a second elevator controlled by the elevator control apparatus is forwarded toward a first waiting floor, the forwarding means forwards the first elevator to a second waiting floor.

11. The elevator control system according to claim 1, wherein the group management control means assigns a landing call to the first elevator without calculating a predicted wait time for responding to the landing call.

12. The elevator control system of claim 1, wherein the group management control means assigns a landing call to the first elevator without comparing predicted wait times of the first elevator and other elevators in responding to the landing call.

13. The elevator control system of claim 1, wherein the group management control means assigns a landing call to the first elevator without calculating or comparing predicted wait times of the first elevator and other elevators in responding to the landing call.

14. The elevator control system according to claim 2, wherein the car control means includes call response means, and, when the first elevator responds first to a landing call assigned to a plurality of elevators, the call response means issues a response signal to the landing call and issues a signal to the other elevators to cancel the landing call assigned to the other elevators.

15. The elevator control system according to claim 5, wherein the assignment review means cancels the assignment of the first elevator if the assignment is to a location forward of the travelling direction of the first elevator and forward of the travelling direction of the other elevators.

16. The elevator control system according to claim 6, wherein the assignment review means cancels the assignment of the first elevator if the assignment is to a location forward of the travelling direction of the first elevator and forward of the travelling direction of the other elevators.

* * * * *